US011239555B2

(12) United States Patent
Behdad et al.

(10) Patent No.: US 11,239,555 B2
(45) Date of Patent: Feb. 1, 2022

(54) 2-BIT PHASE QUANTIZATION PHASED ARRAY ELEMENT

(71) Applicant: Wisconsin Alumni Research Foundation, Madison, WI (US)

(72) Inventors: Nader Behdad, Oregon, WI (US); John H. Booske, McFarland, WI (US); Hung Thanh Luyen, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 224 days.

(21) Appl. No.: 16/595,961

(22) Filed: Oct. 8, 2019

(65) Prior Publication Data

US 2021/0280972 A1 Sep. 9, 2021

(51) Int. Cl.

| | |
|---|---|
| ***H01Q 3/38*** | (2006.01) |
| ***H01Q 15/00*** | (2006.01) |
| ***H01Q 3/24*** | (2006.01) |

(52) U.S. Cl.

CPC ..... *H01Q 3/38* (2013.01); *H01Q 3/247* (2013.01); *H01Q 15/002* (2013.01)

(58) Field of Classification Search

CPC ..... H01Q 9/04; H01Q 15/14; H01Q 19/06; H01Q 19/17; H01Q 3/38; H01Q 3/247; (Continued)

(56) References Cited

U.S. PATENT DOCUMENTS 4,381,509 A 4/1983 Rotman et al.
4,588,994 A 5/1986 Tang et al.
(Continued)

FOREIGN PATENT DOCUMENTS

EP 2182582 A1 5/2010
EP 2221919 A1 8/2010
(Continued)

OTHER PUBLICATIONS

Rao et al., Measurement Results of an Affordable Hybrid Phased Array Using a Radant Lens, Naval Research Laboratory Memo Report No. 5320--00-8439, May 15, 2000, Washington, D.C.
Römisch et al., Multi-Beam Discrete Lens Arrays with Amplitude-Controlled Steering, 2003 IEEE MTT-S International Microwave Symposium Digest, Philadelphia, PA, Jun. 2003, pp. 1669-1672.
(Continued)

*Primary Examiner* — Andrea Lindgren Baltzell
*Assistant Examiner* — Yonchan J Kim
(74) *Attorney, Agent, or Firm* — Bell & Manning, LLC

(57) ABSTRACT

A phase shift element includes a first dielectric layer, a conductive layer, a second dielectric layer, a conducting pattern layer, switches, and vertical interconnect accesses (vias). Each conductor of a plurality of conductors of the conducting pattern layer is orthogonal to two other conductors. Each switch is switchable between a conducting position and a non-conducting position. Each via is connected to a single conductor. The first conductive material reflects an electromagnetic wave incident on the conducting pattern layer and on the second dielectric layer. When a switch is in the conducting position, the switch electrically connects two conductors to each other through their respective vias. A plurality of different switch configurations of the switches provide a 2-bit phase quantization on the reflected electromagnetic wave relative to the electromagnetic wave incident on the conducting pattern layer when the electromagnetic wave is incident on the conducting pattern layer.

20 Claims, 31 Drawing Sheets

(58) Field of Classification Search
CPC .. H01Q 15/002; H01Q 15/148; H01Q 15/006; H01Q 15/0006; H01Q 1/42; H01Q 15/24
See application file for complete search history.

(56) References Cited

U.S. PATENT DOCUMENTS

| | | | | |
|---|---|---|---|---|
| 4,684,952 | A | 8/1987 | Munson et al. | |
| 5,389,939 | A | 2/1995 | Tang et al. | |
| 5,821,908 | A | 10/1998 | Sreenivas | |
| 6,351,240 | B1 * | 2/2002 | Karimullah | H01Q 3/38 343/700 MS |
| 6,388,616 | B1 | 5/2002 | Zhou | |
| 6,531,989 | B1 | 3/2003 | Barker et al. | |
| 6,911,941 | B2 | 6/2005 | Tebbe et al. | |
| 6,987,591 | B2 | 1/2006 | Shaker et al. | |
| 7,113,131 | B2 | 9/2006 | Burke | |
| 7,298,555 | B2 | 11/2007 | Capps | |
| 7,898,480 | B2 | 3/2011 | Ebling et al. | |
| 8,134,511 | B2 | 3/2012 | Koh et al. | |
| 8,811,511 | B2 | 8/2014 | Sayeed et al. | |
| 8,941,540 | B2 | 1/2015 | Harper et al. | |
| 9,368,879 | B1 | 6/2016 | Manry, Jr. | |
| 9,425,512 | B2 | 8/2016 | Maruyama et al. | |
| 9,640,867 | B2 | 5/2017 | Behdad et al. | |
| 2004/0017331 | A1 | 1/2004 | Crawford et al. | |
| 2004/0104860 | A1 | 6/2004 | Durham et al. | |
| 2006/0028386 | A1 | 2/2006 | Ebling et al. | |
| 2006/0044199 | A1 | 3/2006 | Furuhi et al. | |
| 2008/0055175 | A1 | 3/2008 | Rebeiz et al. | |
| 2008/0088525 | A1 | 4/2008 | Jonathan | |
| 2008/0284668 | A1 | 11/2008 | Justice et al. | |
| 2009/0273527 | A1 | 11/2009 | Behdad | |
| 2010/0033389 | A1 | 2/2010 | Yonak et al. | |
| 2010/0103049 | A1 | 4/2010 | Tabakovic | |
| 2010/0194663 | A1 | 8/2010 | Rothwell et al. | |
| 2010/0207833 | A1 | 8/2010 | Toso et al. | |
| 2010/0220035 | A1 | 9/2010 | Lee et al. | |
| 2010/0225562 | A1 | 9/2010 | Smith | |
| 2010/0283695 | A1 | 11/2010 | Geterud | |
| 2011/0025432 | A1 | 2/2011 | Gagnon et al. | |
| 2011/0175780 | A1 | 7/2011 | Gatti et al. | |
| 2011/0210903 | A1 | 9/2011 | Saraband et al. | |
| 2012/0033618 | A1 | 2/2012 | Wallace et al. | |
| 2012/0056787 | A1 | 3/2012 | Tatarnikov et al. | |
| 2012/0088459 | A1 | 4/2012 | Neto et al. | |
| 2013/0322495 | A1 | 12/2013 | Behdad et al. | |
| 2019/0348768 | A1 * | 11/2019 | Behdad | H01Q 19/10 |
| 2020/0243968 | A1 | 7/2020 | Behdad et al. | |

FOREIGN PATENT DOCUMENTS

| | | | |
|---|---|---|---|
| WO | WO 2007/127955 | A2 | 11/2007 |
| WO | WO 2008/061107 | A2 | 5/2008 |

OTHER PUBLICATIONS

Römisch et al., Multibeam Planar Discrete Millimeter-Wave Lens for Fixed-Formation Satellites, 2002 URSI General Assembly Digest, Maastricht, The Netherlands, Aug. 2002.
Abbaspour-Tamijani et al., A planar filter-lens array for millimeter-wave applications, Proceedings of the IEEE International Antennas and Propagation Society International Symposium, vol. 1, Monterey, CA, Jun. 20-25, 2004, pp. 675-678.
International Search Report and Written Opinion received in PCT/US2011/045911, dated Jan. 19, 2012.
Lee et al., Multi-Beam Phased Array Antennas, Jan. 1, 2002, http://www.archive.org/details/nasa_techdoc_20030020930.
Chen et al., "Ultra-wideband polarization conversion metasurfaces based on multiple plasmon resonances," J. Appl. Phys., vol. 115, No. 15, p. 154504, (2014).
Hong et al., Spatial Processing With Lens Antenna Arrays For Direction-of-Arrival Estimation, Proceedings from "International Union of Radio Science" 27th General Assembly, Aug. 17-24, 2002, Maastricht, the Netherlands, http://www.ursi.org/Proceedings/ProcGA02/ursiga02.pdf.
Schoenberg et al., Two-level power combining using a lens amplifier, IEEE Trans. Microwave Theory Techn., Dec. 1994, vol. 42, No. 12, pp. 2480-2485.
Jia et al., "Broadband polarization rotation reflective surfaces and their applications to RCS reduction," IEEE Trans Antennas Propag., vol. 64, No. 1, pp. 179-188, Jan. 2016.
Liu et al., "Wideband RCS reduction of a slot array antenna using polarization conversion metasurfaces," IEEE Trans Antennas Propag., vol. 64, No. 1, pp. 326-331, Jan. 2016.
Ongareau et al., "Radar cross-section reduction by polarization rotation", Microw. Opt. Techn. Let., vol. 8, No. 6, pp. 316-318, (1995).
Shiroma et al., A quasi-optical receiver with angle diversity, Proceedings of the IEEE International Microwave Symposium, San Francisco, 1996, pp. 1131-1134.
Mcgrath, Planar three-dimensional constrained lenses, IEEE Trans. Antennas Propagat., Jan. 1986, vol. 34, No. 1, pp. 46-50.
Hollung et al., A bi-directional quasi-optical lens amplifier, IEEE Trans. Microwave Theory Techn., Dec. 1997, vol. 45, No. 12, pp. 2352-2357.
Popovic et al., Quasi-optical transmit/receive front ends, IEEE Trans. Microwave Theory Techn., Nov. 1998, vol. 48, No. 11, pp. 1964-1975.
Zhou et al., "A polarization-rotating SIW reflective surface with two sharp band edges," IEEE Antennas Wireless Propag. Lett., vol. 15, pp. 130-134, May 13, 2015.
H. Luyen, Z. Zhang, J. H. Booske, and N. Behdad, Wideband, Beamsteerable Reflect arrays based on minimum-switch topology, Polarization rotating unit cells, IEEE Access, vol. 7, pp. 36568-36578, 2019.
Pozar, Flat lens antenna concept using aperture coupled microstrip patches, Electronics Letters, Nov. 7, 1996, vol. 32, No. 23, pp. 2109-2111.
Sauleau et al., Quasi axis-symmetric integrated lens antennas: design rules and experimental/manufacturing trade-offs at millimeter-wave frequencies, Microwave and Optical Technology Letters, Jan. 2006, vol. 48, No. 1, pp. 20-29.
Al-Joumayly et al., Slide presentation of "Design of conformal, high-resolution microwave lenses using sub wavelength periodic structures", 2010 IEEE Antennas and Propagation Society/URSI Symposium, Toronto, ON, Jul. 11-17, 2010.
Al-Joumayly et al., Abstract of "Design of conformal, high-resolution microwave lenses using sub wavelength periodic structures", 2010 IEEE Antennas and Propagation Society/URSI Symposium, Toronto, ON, Jul. 11, 2010.
Al-Joumayly et al., Power Point Presentation "Wideband True-Time-Delay Microwave Lenses Using Low-Profile, Sub-Wavelength Periodic Structures", Jul. 2011.
Abadi et al., Ultra-Wideband, True-Time-Delay Reflectarray Antennas Using Ground-Plane-Backed, Miniaturized-Element Frequency Selective Surfaces, IEEE Transactions On Antennas and Propagation, vol. 63, No. 2, Dec. 18, 2014, pp. 534-542.
Abadi et al., Harmonic-Suppressed Miniaturized-Element Frequency Selective Surfaces With Higher Order Bandpass Responses, IEEE Transactions On Antennas and Propagation, vol. 62, No. 5, Jan. 30, 2014, pp. 2562-25781.
Li et al., Wideband True-Time-Delay Microwave Lenses Based on Metallo-Dielectric and All-Dielectric Lowpass Frequency Selective Surfaces, IEEE Transactions On Antennas and Propagation, vol. 61, No. 8, May 17, 2013, pp. 4109-4119.
Li et al., Frequency Selective Surfaces for Pulsed High-Power Microwave Applications, IEEE Transactions On Antennas and Propagation, vol. 61, No. 2, Oct. 18, 2012, pp. 677-687.
Li et al., All-Dielectric, True-Time-Delay, Planar Microwave Lenses, Antennas and Propagation Society International Symposium, Jul. 7, 2013, Orlando, FL, IEEE, pp. 1172-1173.
Li et al., Broadband True-Time-Delay Microwave Lenses Based on Miniaturized Element Frequency Selective Surfaces, IEEE Transactions On Antennas and Propagation, vol. 61, No. 3, Nov. 16, 2012, pp. 1166-1179.

* cited by examiner

2-BIT PHASE QUANTIZATION PHASED ARRAY ELEMENT

REFERENCE TO GOVERNMENT RIGHTS

This invention was made with government support under N00014-16-1-2308 awarded by the US Navy/ONR. The government has certain rights in the invention.

BACKGROUND

A phased array antenna is an array of antennas in which a relative phase of signals feeding each antenna is varied such that an effective radiation pattern of the array is reinforced in a desired direction and suppressed in undesired directions to provide electronic steering of a beam. To convert a reflector array into a beam steerable antenna, a phase shift distribution provided by spatial phase shifting pixels is dynamically changed depending on the direction of the desired output beam in the far field.

Beams are formed by shifting the phase of the signal emitted from each radiating element to provide either constructive or destructive interference to steer the beam. These antenna systems come in different sizes and scales due to several factors such as frequency and power requirements. High-power phased array antenna technology that yields an affordable system is a major problem in the commercial and military wireless industry. The cost of current phased array antenna technology is a major factor that limits application to the most expensive military systems. Additionally, the solid-state technology that lies at the heart of current phased array antenna technology has inherent limitations when it comes to power and heat handling capability due to the generation of a large amount of heat.

Reflective array antennas have been increasingly investigated in recent years as affordable solutions to provide beam collimation and adaptive pattern scanning for a wide range of wireless communication systems. A reflective array antenna is typically used to collimate the wave front generated by a low-gain feed antenna. Each unit cell of the reflective array antenna acts as a spatial phase shifter to scatter the incident wave with a specific phase shift to realize a desired phase profile for the reflected wave over the array's aperture to form a high gain pencil beam at an intended direction. The direction of the main beam can be steered by adaptively changing the reflection phase of each array element. Ideally, it is desirable to have the reflective array antenna's unit cells that can be reconfigured to yield any arbitrary phase shift values between 0° and 360° to provide perfect phase correction. However, the reconfiguration techniques to achieve any arbitrary phase shift values between 0° and 360° require changing the control voltage continuously and individually configuring the unit cells, which results in a relatively sophisticated architecture for voltage supply circuitry. Moreover, it is challenging to realize the full, reconfigurable 0° to 360° phase range over a broad frequency range (e.g., with fractional bandwidth of larger than 10%). These limitations reduce the practicality of these reconfiguration techniques for various scenarios where reflective array antennas having large numbers of unit cells and wideband operation are needed. Therefore, instead of fulfilling a continuous 0° to 360° phase range, discrete phase correction schemes that quantize this phase range into a number of discrete levels have been widely adopted in order to reduce the complexity of the control circuitry and increase operating bandwidths of beam-steerable reflective array antennas.

The simplest phase quantization scheme is 1-bit, which has been demonstrated as sufficient for beam scanning operation. The use of only two phase states for reconfigurable unit cells significantly reduces the complexity of the unit cell design and the digital control circuit compared to a phase correction scheme using a higher number of phase states. However, the 1-bit discretization results in a large phase error accumulated over a reflective array antenna's aperture reducing the directivity by about 3.7 decibel (dB) compared to that achieved by a perfectly collimated reflective array antenna. Improving the phase quantization to 2-bit (e.g., four phase states) helps recover about 3 dB of this 3.7-dB directivity reduction, which is a significant improvement. Increasing the number of phase states beyond four yields only a modest increase in the directivity of less than 0.7 dB. This modest increase can be easily canceled by the higher losses due to additional switches and more complicated unit cell designs. Indeed, a number of publications reveal that an average phase shifter loss is about 1 dB/bit. This means adding one more bit to the phase correction scheme generally increases the overall system loss by 1 dB. Taking into account this phase shifter loss, an array using 3-bit phase shifters, while providing about a 0.5 dB higher directivity gain, provides a slightly lower realized gain compared to one using 2-bit phase shifters. In an electronically reconfigurable reflective array antenna, a large fraction of the fabrication cost is often due to the switches (e.g., PIN-diode, MEMS switches) used for reconfiguration. Therefore, moving from a 1-bit to a 2-bit phase quantization scheme for reconfigurable reflective array antennas provides the biggest performance improvement.

SUMMARY

In an illustrative embodiment, a phase shift element is provided. The phase shift element includes, but is not limited to, a first dielectric layer, a conductive layer, a second dielectric layer, a conducting pattern layer, a plurality of switches, and a plurality of vertical interconnect accesses (vias). The first dielectric layer includes a top, first dielectric surface and a bottom, first dielectric surface. The top, first dielectric surface is on an opposite side of the first dielectric layer relative to the bottom, first dielectric surface. The first dielectric layer is formed of a first dielectric material. The conductive layer includes a top conductive surface and a bottom conductive surface. The top conductive surface is on an opposite side of the first conductive layer relative to the bottom conductive surface. The bottom conductive surface is mounted to the top, first dielectric surface. The conductive layer is formed of a first conductive material. The second dielectric layer includes a top, second dielectric surface and a bottom, second dielectric surface. The top, second dielectric surface is on an opposite side of the second dielectric layer relative to the bottom, second dielectric surface. The bottom, second dielectric surface is mounted to the top conductive surface. The second dielectric layer is formed of a second dielectric material. The conducting pattern layer includes a plurality of conductors mounted to the top, second dielectric surface. The conducting pattern layer is formed of a second conductive material. Each conductor of the plurality of conductors is orthogonal to two other conductors of the plurality of conductors. The plurality of switches are mounted to the bottom, first dielectric surface. Each switch of the plurality of switches is configured to be switchable between a conducting position and a non-conducting position. Each vertical interconnect access (via) of the plurality of vias is formed of a third conductive material that extends through the first dielectric layer, through a third dielectric material formed in and through the conductive layer, and through the second dielectric layer. Each via of the plurality of vias is connected to a single conductor of the plurality of conductors. The first conductive material is configured to reflect an electromagnetic wave incident on the conducting pattern layer and on the second dielectric layer. When a switch of the plurality of switches is in the conducting position, the switch electrically connects two conductors of the plurality of conductors to each other through their respective vias. A plurality of different switch configurations of the plurality of switches provide a 2-bit phase quantization on the reflected electromagnetic wave relative to the electromagnetic wave incident on the conducting pattern layer when the electromagnetic wave is incident on the conducting pattern layer.

In another illustrative embodiment, a phased array antenna is provided. The phased array antenna includes, but is not limited to, a first dielectric layer, a conductive layer, a second dielectric layer, a conducting pattern layer, and a plurality of phase shift elements distributed in a direction. The first dielectric layer includes a top, first dielectric surface and a bottom, first dielectric surface. The top, first dielectric surface is on an opposite side of the first dielectric layer relative to the bottom, first dielectric surface. The first dielectric layer is formed of a first dielectric material. The conductive layer includes a top conductive surface and a bottom conductive surface. The top conductive surface is on an opposite side of the first conductive layer relative to the bottom conductive surface. The bottom conductive surface is mounted to the top, first dielectric surface. The conductive layer is formed of a first conductive material. The second dielectric layer includes a top, second dielectric surface and a bottom, second dielectric surface. The top, second dielectric surface is on an opposite side of the second dielectric layer relative to the bottom, second dielectric surface. The bottom, second dielectric surface is mounted to the top conductive surface. The second dielectric layer is formed of a second dielectric material.

Each phase shift element of the plurality of phase shift elements comprises a conducting pattern layer, a plurality of switches, and a plurality of vertical interconnect accesses (vias). The conducting pattern layer includes a plurality of conductors mounted to the top, second dielectric surface. The conducting pattern layer is formed of a second conductive material. Each conductor of the plurality of conductors is orthogonal to two other conductors of the plurality of conductors. The plurality of switches is mounted to the bottom, first dielectric surface. Each switch of the plurality of switches is configured to be switchable between a conducting position and a non-conducting position. Each vertical interconnect access (via) of the plurality of vias is formed of a third conductive material that extends through the first dielectric layer, through a third dielectric material formed in and through the conductive layer, and through the second dielectric layer. Each via of the plurality of vias is connected to a single conductor of the plurality of conductors. The first conductive material is configured to reflect an electromagnetic wave incident on the conducting pattern layer and on the second dielectric layer. When a switch of the plurality of switches is in the conducting position, the switch electrically connects two conductors of the plurality of conductors to each other through their respective vias. A plurality of different switch configurations of the plurality of switches provide a 2-bit phase quantization on the reflected electromagnetic wave relative to the electromagnetic wave incident on the conducting pattern layer when the electromagnetic wave is incident on the conducting pattern layer. A switch configuration of each phase shift element of the plurality of phase shift elements is selected such that the plurality of phase shift elements generates a main beam of the reflected electromagnetic wave in a preselected direction when the electromagnetic wave is incident on the conducting pattern layer.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
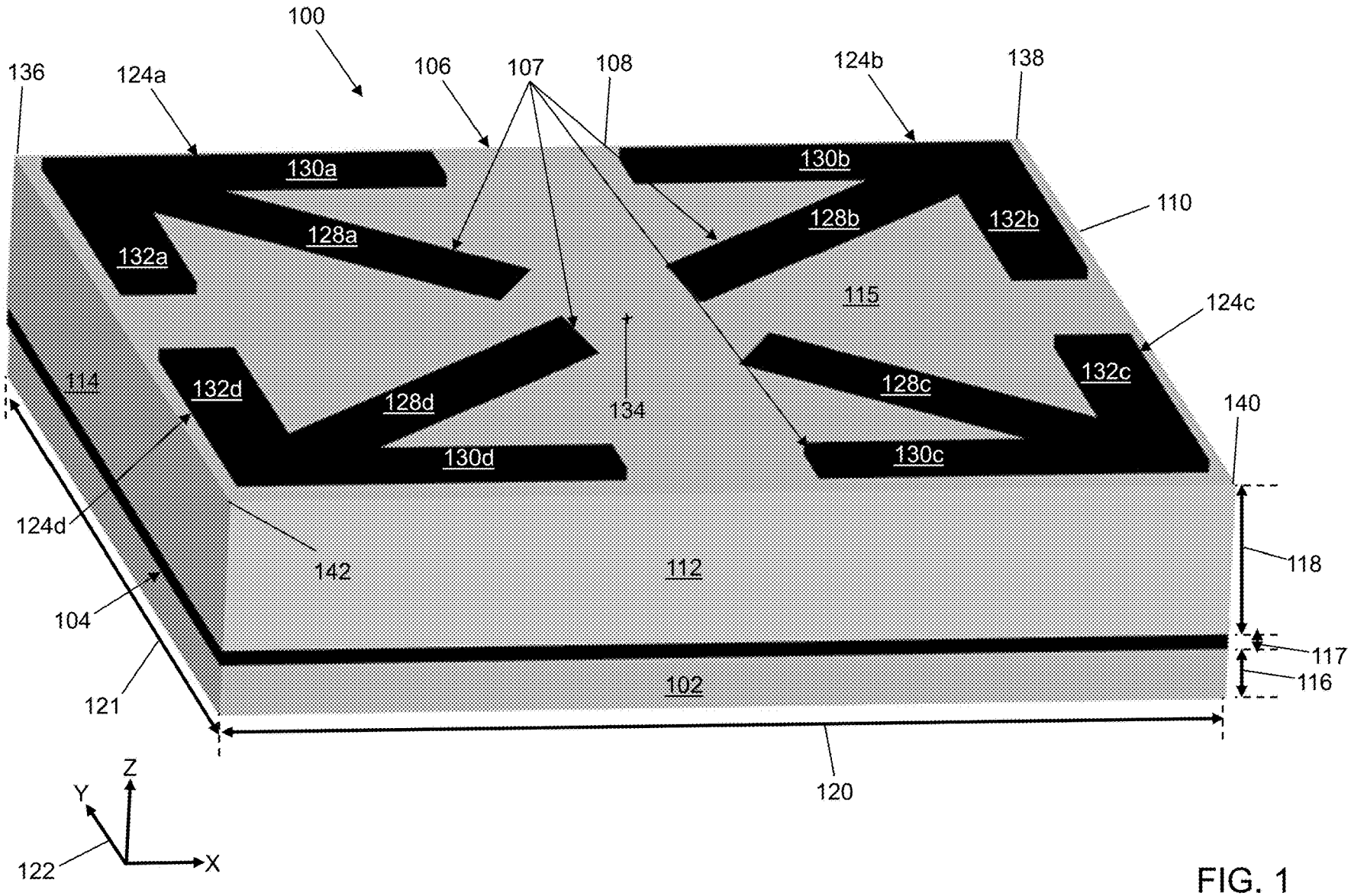
FIG. 1 depicts a perspective side view of a 2-bit phase shift element in accordance with an illustrative embodiment.
Figure 2:
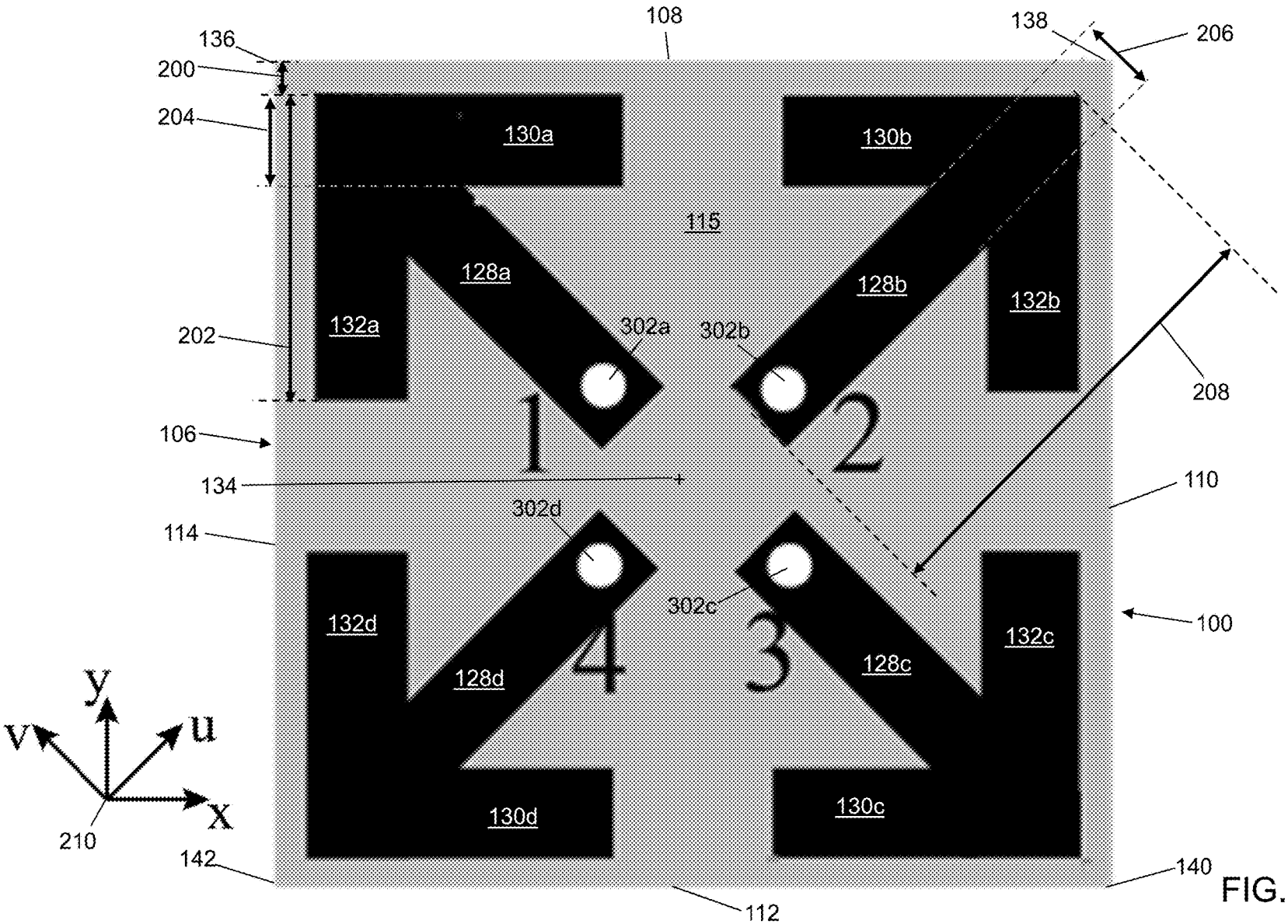
FIG. 2 depicts a top view of the 2-bit phase shift element of FIG. 1 in accordance with an illustrative embodiment.
Figure 3:
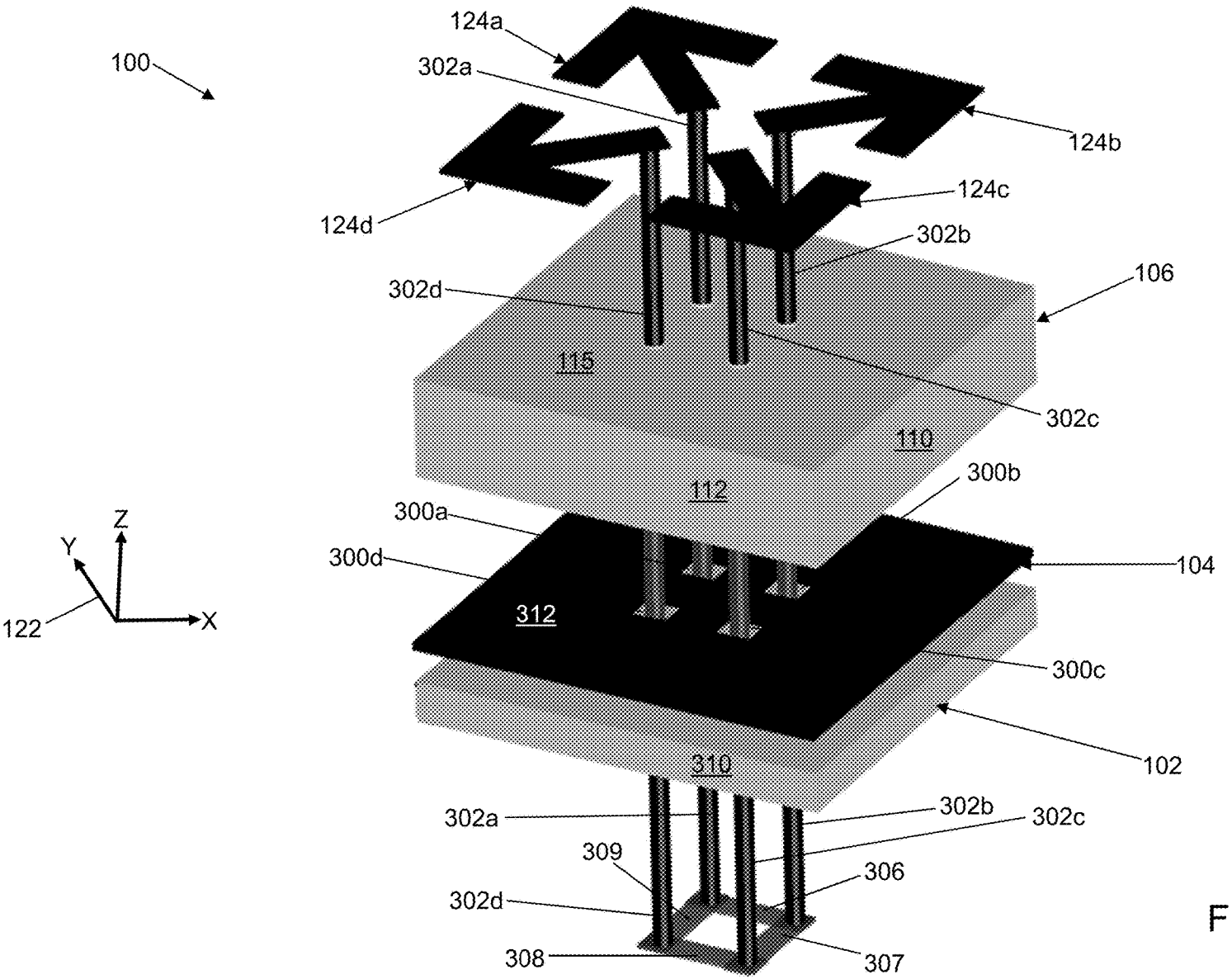
FIG. 3 depicts an exploded, perspective side view of the 2-bit phase shift element of FIG. 1 in accordance with an illustrative embodiment.

Referring to FIG. 1, a perspective side view of a 2-bit phase shift element 100 is shown in accordance with an illustrative embodiment. Referring to FIG. 2, a top view of 2-bit phase shift element 100 is shown in accordance with an illustrative embodiment. Referring to FIG. 3, an exploded, perspective side view of 2-bit phase shift element 100 is shown in accordance with an illustrative embodiment. Referring to FIGS. 4A to 4D, a bottom view of 2-bit phase shift element 100 is shown in accordance with an illustrative embodiment with switches arranged to define a first mode, a second mode, a third mode, and a fourth mode, respectively. Each of first mode, second mode, third mode, and fourth mode define a distinct phase state of 2-bit phase shift element 100 as discussed further below. Referring to FIG. 4E, an incident electric wave and a corresponding reflected electric wave generated based on the operating mode of the switches of FIGS. 4A to 4D are illustrated in accordance with an illustrative embodiment.

2-bit phase shift element 100 provides 2-bit phase quantization for a beam-steerable reflective array by exploiting four distinct reflection modes of a unit cell comprised of 2-bit phase shift element 100 to define four distinct phase states. Two of the four modes represent polarization-rotation operation while the other two modes represent non-polarization-rotation operation when the unit cell is illuminated by an x-polarized or a y-polarized incident wave. With a specific phase relation between the four reflection modes, 2-bit phase shift element 100 acts as a 2-bit phase shifter under illumination of an incident wave polarized along a first diagonal direction (u-direction) of 2-bit phase shift element 100 as described further below.

2-bit phase shift element 100 may include a first dielectric layer 102, a conducting layer 104, a second dielectric layer 106, and a conducting pattern layer 107. 2-bit phase shift element 100 can be used as a spatial phase shifter of a single-layer, wideband reflective array antenna. 2-bit phase shift element 100 can be switched between a first configuration defined by first switch positions, a second configuration defined by second switch positions, a third configuration defined by third switch positions, and a fourth configuration defined by fourth switch positions shown in FIGS. 4A to 4D, respectively.

First dielectric layer 102 is formed of one or more dielectric materials that may include foamed polyethylene, solid polyethylene, polyethylene foam, polytetrafluoroethylene, air, air space polyethylene, vacuum, etc. Illustrative dielectric materials include RO4003C laminate and RO3006 laminate sold by Rogers Corporation headquartered in Chandler, Ariz., USA.

Second dielectric layer 106 is also formed of one or more dielectric materials. First dielectric layer 102 and second dielectric layer 106 may be formed of the same or different dielectric materials and the same or a different number of layers of dielectric material.

Conducting layer 104 may be formed of a sheet of conductive material such as copper plated steel, silver plated steel, silver plated copper, silver plated copper clad steel, copper, copper clad aluminum, steel, etc. Conducting layer 104 is a conducting surface with high conductivity that reflects received electromagnetic waves. Conducting layer 104 is connected to a fixed potential that may be, but is not necessarily, a ground potential. Conducting layer 104 may be generally flat or formed of ridges or bumps. For illustration, conducting layer 104 may be formed of a flexible membrane coated with a conductor.

Conducting pattern layer 107 also may be formed of a conductive material such as copper plated steel, silver plated steel, silver plated copper, silver plated copper clad steel, copper, copper clad aluminum, steel, etc. Conducting layer 104 and conducting pattern layer 107 may be formed of the same or a different conductive material.

Conducting layer 104 is mounted between first dielectric layer 102 and second dielectric layer 106 such that a top surface 310 of first dielectric layer 102 is mounted to a bottom surface of conducting layer 104, and second dielectric layer 106 is mounted to a top surface 312 of conducting layer 104. Each of first dielectric layer 102, conducting layer 104, and second dielectric layer 106 has a generally square top and bottom surface shape in an x-y plane and a thickness in a vertical direction denoted by a z-axis, where an x-axis is perpendicular to a y-axis, and both the x-axis and the y-axis are perpendicular to the z-axis to form a right-handed coordinate 3-dimensional (D) reference frame denoted x-y-z frame 122. First dielectric layer 102, conducting layer 104, and second dielectric layer 106 have a length 120 parallel to the x-axis, and a width 121 parallel to the y-axis. In the illustrative embodiment, length 120 is equal to width 121.

Second dielectric layer 106 has a back wall 108, a right-side wall 110, a front wall 112, a left-side wall 114, a top surface 115, and a bottom surface (not shown). The bottom surface of second dielectric layer 106 is mounted to top surface 312 of conducting layer 104 though again second dielectric layer 106 may be formed of a plurality of dielectric layers such that a bottom layer is mounted to top surface 312 of conducting layer 104.

The top and bottom surfaces of each of first dielectric layer 102, conducting layer 104, and second dielectric layer 106 are generally flat. First dielectric layer 102 has a first thickness 116 parallel to the z-axis. Conducting layer 104 has a second thickness 117 parallel to the z-axis. Second dielectric layer 106 has a third thickness 118 parallel to the z-axis.

Conducting pattern layer 107 is formed on top surface 115 of second dielectric layer 106 opposite conducting layer 104 though again second dielectric layer 106 may be formed of a plurality of dielectric layers such that conducting pattern layer 107 is mounted to top surface 312 of a top layer of second dielectric layer 106. Conducting pattern layer 107 includes a first corner conductor 124*a*, a second corner conductor 124*b*, a third corner conductor 124*c*, and a fourth corner conductor 124*d*. In the illustrative embodiment, first corner conductor 124*a*, second corner conductor 124*b*, third corner conductor 124*c*, and fourth corner conductor 124*d* each form an open arrow shape with arrow tip arms separated by 90 degrees and each arrow tip pointed at 135°, 45°, 315°, and 225°, respectively, in the x-y plane and relative to the +x-direction. Thus, a tip of each open arrow shape is pointed in a direction that is rotated 90° relative to each adjacent tip.

First corner conductor 124*a*, second corner conductor 124*b*, third corner conductor 124*c*, and fourth corner conductor 124*d* are symmetrically distributed relative to each corner of top surface 115 of second dielectric layer 106. First corner conductor 124*a* and second corner conductor 124*b* form a mirror image of third corner conductor 124*c* and fourth corner conductor 124*d* relative to an x-z center plane through a center 134 of top surface 115 of second dielectric layer 106. The x-z center plane is parallel to the x-z plane defined by x-y-z frame 122. First corner conductor 124*a* and fourth corner conductor 124*d* form a mirror image of second corner conductor 124*b* and third corner conductor 124*c* relative to a y-z center plane through center 134 of top surface 115 of second dielectric layer 106. The y-z center plane is parallel to the y-z plane defined by x-y-z frame 122.

First corner conductor 124*a* is positioned in an upper left quadrant of top surface 115 of second dielectric layer 106. First corner conductor 124*a* includes a first connecting arm 128*a*, a first x-arm 130*a*, and a first y-arm 132*a*. First x-arm 130*a* and first y-arm 132*a* are perpendicular to each other. First connecting arm 128*a* is parallel to a v-axis where v=−x+y, as shown by an x-y-u-v 2-D reference frame 210. First x-arm 130*a* and first y-arm 132*a* are joined to form the arrowhead shape in an upper left corner 136 pointed in the v-axis direction, and first connecting arm 128*a* is joined to first x-arm 130*a* and first y-arm 132*a* to form the shaft that extends from the arrowhead shape toward center 134. As a result, first connecting arm 128*a* is aligned with and extends from the tip formed at the intersection of first x-arm 130*a* and first y-arm 132*a*. First connecting arm 128*a*, first x-arm 130*a*, and first y-arm 132*a* are used to describe a shape of first corner conductor 124*a* and typically are not distinct elements but form a single conductive structure.

A first vertical interconnect access (via) 302*a* connects to first corner conductor 124*a* adjacent an edge of first connecting arm 128*a* closest to center 134. First connecting arm 128*a* connects first x-arm 130*a* and first y-arm 132*a* to first via 302*a*. First connecting arm 128*a* extends parallel to a second diagonal axis defined by the v-axis between center 134 and upper left corner 136. The first diagonal axis defined by a u-axis is perpendicular to the second diagonal axis, the v-axis, and both the u-axis and the v-axis are perpendicular to the z-axis to form a right-handed coordinate 3-D reference frame denoted a u-v-z frame. First x-arm 130*a* extends from upper left corner 136 towards an upper right corner 138 parallel to the x-axis. First y-arm 132*a* extends from upper left corner 136 towards a lower left corner 142 parallel to the y-axis.

First x-arm 130*a* is a first distance 200 from back wall 108. First y-arm 132*a* is first distance 200 from left-side wall 114. First x-arm 130*a* has a corner arm length 202 and a corner arm width 204. First y-arm 132*a* has corner arm length 202 and corner arm width 204. First connecting arm 128*a* has an arm length 208 and an arm width 206. For simplicity of description, first x-arm 130*a*, first y-arm 132*a*, and first connecting arm 128*a* have been described to overlap near an upper left corner 136 though again first connecting arm 128*a*, first x-arm 130*a*, and first y-arm 132*a* typically are not distinct elements, but form a single conductive structure.

First via 302*a* forms an electrical connection between first connecting arm 128*a* and a first throw arm 306 of a first switch (not shown) and a fourth throw arm 309 of a fourth switch (not shown) through first dielectric layer 102, conducting layer 104, and second dielectric layer 106 to form an electronic circuit. First via 302*a* is formed of a conductive material. A first dielectric patch 300*a* is formed through conducting layer 104 of a dielectric material. First via 302*a* extends generally parallel to the z-axis through first dielectric patch 300*a*.

Second corner conductor 124*b* is positioned in an upper right quadrant of top surface 115 of second dielectric layer 106. Second corner conductor 124*b* includes a second connecting arm 128*b*, a second x-arm 130*b*, and a second y-arm 132*b*. Second x-arm 130*b* and second y-arm 132*b* are perpendicular to each other. Second connecting arm 128*b* is parallel to the u-axis where u=x+y, as shown by x-y-u-v frame 210. Second x-arm 130*b* and second y-arm 132*b* are joined to form the arrowhead shape in upper right corner 138 pointed in the u-axis direction, and second connecting arm 128*b* is joined to second x-arm 130*b* and second y-arm 132*b* to form the shaft that extends from the arrowhead shape toward center 134. As a result, second connecting arm 128*b* is aligned with and extends from the tip formed at the intersection of second x-arm 130*b* and second y-arm 132*b*. Second connecting arm 128*b*, second x-arm 130*b*, and second y-arm 132*b* are used to describe a shape of second corner conductor 124*b* and typically are not distinct elements but form a single conductive structure.

A second via 302*b* connects to second corner conductor 124*b* adjacent an edge of second connecting arm 128*b* closest to center 134. Second connecting arm 128*b* connects second x-arm 130*b* and second y-arm 132*b* to second via 302*b*. Second connecting arm 128*b* extends parallel to the u-axis between center 134 and upper right corner 138. Second x-arm 130*b* extends from upper right corner 138 towards upper left corner 136 parallel to the x-axis. Second y-arm 132*b* extends from upper right corner 138 towards a lower right corner 140 parallel to the y-axis.

Second x-arm 130*b* is first distance 200 from back wall 108. Second y-arm 132*b* is first distance 200 from right-side wall 110. Second x-arm 130*b* has corner arm length 202 and corner arm width 204. Second y-arm 132*b* has corner arm length 202 and corner arm width 204. Second connecting arm 128*b* has arm length 208 and arm width 206. For simplicity of description, second x-arm 130*b*, second y-arm 132*b*, and second connecting arm 128*b* have been described to overlap near upper right corner 138 though again second connecting arm 128*b*, second x-arm 130*b*, and second y-arm 132*b* typically are not distinct elements, but form a single conductive structure.

Second via 302*b* forms an electrical connection between first throw arm 306 of the first switch and a second throw arm 307 of a second switch (not shown) through first dielectric layer 102, conducting layer 104, and second dielectric layer 106 to form an electronic circuit. Second via 302*b* is formed of a conductive material. A second dielectric patch 300*b* is formed through conducting layer 104 of a dielectric material. Second via 302*b* extends generally parallel to the z-axis through second dielectric patch 300*b*.

Third corner conductor 124*c* is positioned in a lower right quadrant of top surface 115 of second dielectric layer 106. Third corner conductor 124*c* includes a third connecting arm 128*c*, a third x-arm 130*c*, and a third y-arm 132*c*. Third x-arm 130*c* and third y-arm 132*c* are perpendicular to each other. Third connecting arm 128*c* is parallel to the v-axis, as shown by x-y-u-v frame 210. Third x-arm 130*c* and third y-arm 132*c* are joined to form the arrowhead shape in lower right corner 140 pointed in the −v-axis direction, and third connecting arm 128*c* is joined to third x-arm 130*c* and third y-arm 132*c* to form the shaft that extends from the arrowhead shape toward center 134. As a result, third connecting arm 128*c* is aligned with and extends from the tip formed at the intersection of third x-arm 130*c* and third y-arm 132*c*. Third connecting arm 128*c* and first connecting arm 128*a* are parallel to each other. Third connecting arm 128*c*, third x-arm 130*c*, and third y-arm 132*c* are used to describe a shape of third corner conductor 124*c* and typically are not distinct elements but form a single conductive structure.

A third via 302*c* connects to third corner conductor 124*c* adjacent an edge of third connecting arm 128*c* closest to center 134. Third connecting arm 128*c* connects third x-arm 130*c* and third y-arm 132*c* to third via 302*c*. Third connecting arm 128*c* extends parallel to the v-axis between center 134 and lower right corner 140. Third x-arm 130*c* extends from lower right corner 140 towards lower left corner 142 parallel to the x-axis. Third y-arm 132*c* extends from lower right corner 140 towards upper right corner 138 parallel to the y-axis.

Third x-arm 130*c* is first distance 200 from front wall 112. Third y-arm 132*c* is first distance 200 from right-side wall 110. Third x-arm 130*c* has corner arm length 202 and corner arm width 204. Third y-arm 132*c* has corner arm length 202 and corner arm width 204. Third connecting arm 128*c* has arm length 208 and arm width 206. For simplicity of description, third x-arm 130*c*, third y-arm 132*c*, and third connecting arm 128*c* have been described to overlap near lower right corner 140 though again third connecting arm 128*c*, third x-arm 130*c*, and third y-arm 132*c* typically are not distinct elements, but form a single conductive structure.

Third via 302*c* forms an electrical connection between second throw arm 307 of the second switch and a third throw arm 308 of a third switch (not shown) through first dielectric layer 102, conducting layer 104, and second dielectric layer 106 to form an electronic circuit. Third via 302*c* is formed of a conductive material. A third dielectric patch 300*c* is formed through conducting layer 104 of a dielectric material. Third via 302*c* extends generally parallel to the z-axis through third dielectric patch 300*c*.

Fourth corner conductor 124*d* is positioned in a lower left quadrant of top surface 115 of second dielectric layer 106. Fourth corner conductor 124*d* includes a fourth connecting arm 128*d*, a fourth x-arm 130*d*, and a fourth y-arm 132*d*. Fourth x-arm 130*d* and fourth y-arm 132*d* are perpendicular to each other. Fourth connecting arm 128*d* is parallel to the u-axis, as shown by x-y-u-v frame 210. Fourth x-arm 130*d* and fourth y-arm 132*d* are joined to form the arrowhead shape in lower left corner 142 pointed in the −u-axis direction, and fourth connecting arm 128*d* is joined to fourth x-arm 130*d* and fourth y-arm 132*d* to form the shaft that extends from the arrowhead shape toward center 134. As a result, fourth connecting arm 128*d* is aligned with and extends from the tip formed at the intersection of fourth x-arm 130*d* and fourth y-arm 132*d*. Fourth connecting arm 128*d* and second connecting arm 128*b* are parallel to each other. Fourth connecting arm 128*d*, fourth x-arm 130*d*, and fourth y-arm 132*d* are used to describe a shape of fourth corner conductor 124*d* and typically are not distinct elements but form a single conductive structure.

A fourth via 302*d* connects to fourth corner conductor 124*d* adjacent an edge of fourth connecting arm 128*d* closest to center 134. Fourth connecting arm 128*d* connects fourth x-arm 130*d* and fourth y-arm 132*d* to fourth via 302*d*. Fourth connecting arm 128*d* extends parallel to the u-axis between center 134 and lower left corner 142. Fourth x-arm 130*d* extends from lower left corner 142 towards lower right corner 140 parallel to the x-axis. Fourth y-arm 132*c* extends from lower left corner 142 towards upper left corner 136 parallel to the y-axis.

Fourth x-arm 130*d* is first distance 200 from front wall 112. Fourth y-arm 132*d* is first distance 200 from left-side wall 114. Fourth x-arm 130*d* has corner arm length 202 and corner arm width 204. Fourth y-arm 132*d* has corner arm length 202 and corner arm width 204. Fourth connecting arm 128*d* has arm length 208 and arm width 206. For simplicity of description, fourth x-arm 130*d*, fourth y-arm 132*d*, and fourth connecting arm 128*d* have been described to overlap near lower left corner 142 though again fourth connecting arm 128*d*, fourth x-arm 130*d*, and fourth y-arm 132*d* typically are not distinct elements, but form a single conductive structure.

Fourth via 302*d* forms an electrical connection between third throw arm 308 of the third switch and fourth throw arm 309 of the fourth switch through first dielectric layer 102, conducting layer 104, and second dielectric layer 106 to form an electronic circuit. Fourth via 302*d* is formed of a conductive material. A fourth dielectric patch 300*d* is formed through conducting layer 104 of a dielectric material. Fourth via 302*d* extends generally parallel to the z-axis through fourth dielectric patch 300*d*.

Inclusion of first x-arms 130*a*, 130*b*, 130*c*, 130*d* perpendicular to first y-arms 132*a*, 132*b*, 132*c*, 132*d*, respectively, allows 2-bit phase shift element 100 to support polarizations parallel to the x-axis as well as the y-axis.

Each of the first switch, the second switch, the third switch, and the fourth switch may be single pole, single throw (SPST) switches or electrical structures that act as a SPST switch. Each of the first switch, the second switch, the third switch, and the fourth switch are mounted to bottom surface 400 of first dielectric layer 102 though again first dielectric layer 102 may be formed of a plurality of dielectric layers such that the first switch, the second switch, the third switch, and the fourth switch are mounted to bottom surface 400 of a bottom layer of first dielectric layer 102. Each of the first switch, the second switch, the third switch, and the fourth switch may be a mechanical switch, a microelectromechanical system (MEMS) switch, a commercially available SPST switch, a plurality of PIN diodes, etc. Each of the first switch, the second switch, the third switch, and the fourth switch form switchable connections that have two states: short referred to as a conducting position and open referred to as a non-conducting position.

In a first position, first throw arm 306 of the first switch is closed to electrically connect first via 302*a* with second via 302*b*. In a second position, first throw arm 306 of the first switch is open to electrically disconnect first via 302*a* from second via 302*b*. In a first position, second throw arm 307 of the second switch is closed to electrically connect second via 302*b* with third via 302*c*. In a second position, first throw arm 306 of the second switch is open to electrically disconnect second via 302*b* from third via 302*c*. In a first position, third throw arm 308 of the third switch is closed to electrically connect third via 302*c* with fourth via 302*d*. In a second position, third throw arm 308 of the third switch is open to electrically disconnect third via 302*c* from fourth via 302*d*. In a first position, fourth throw arm 309 of the fourth switch is closed to electrically connect fourth via 302*d* with first via 302*a*. In a second position, fourth throw arm 309 of the fourth switch is open to electrically disconnect fourth via 302*d* from first via 302*a*.

Figures 4A, 4B, 4C, 4D:
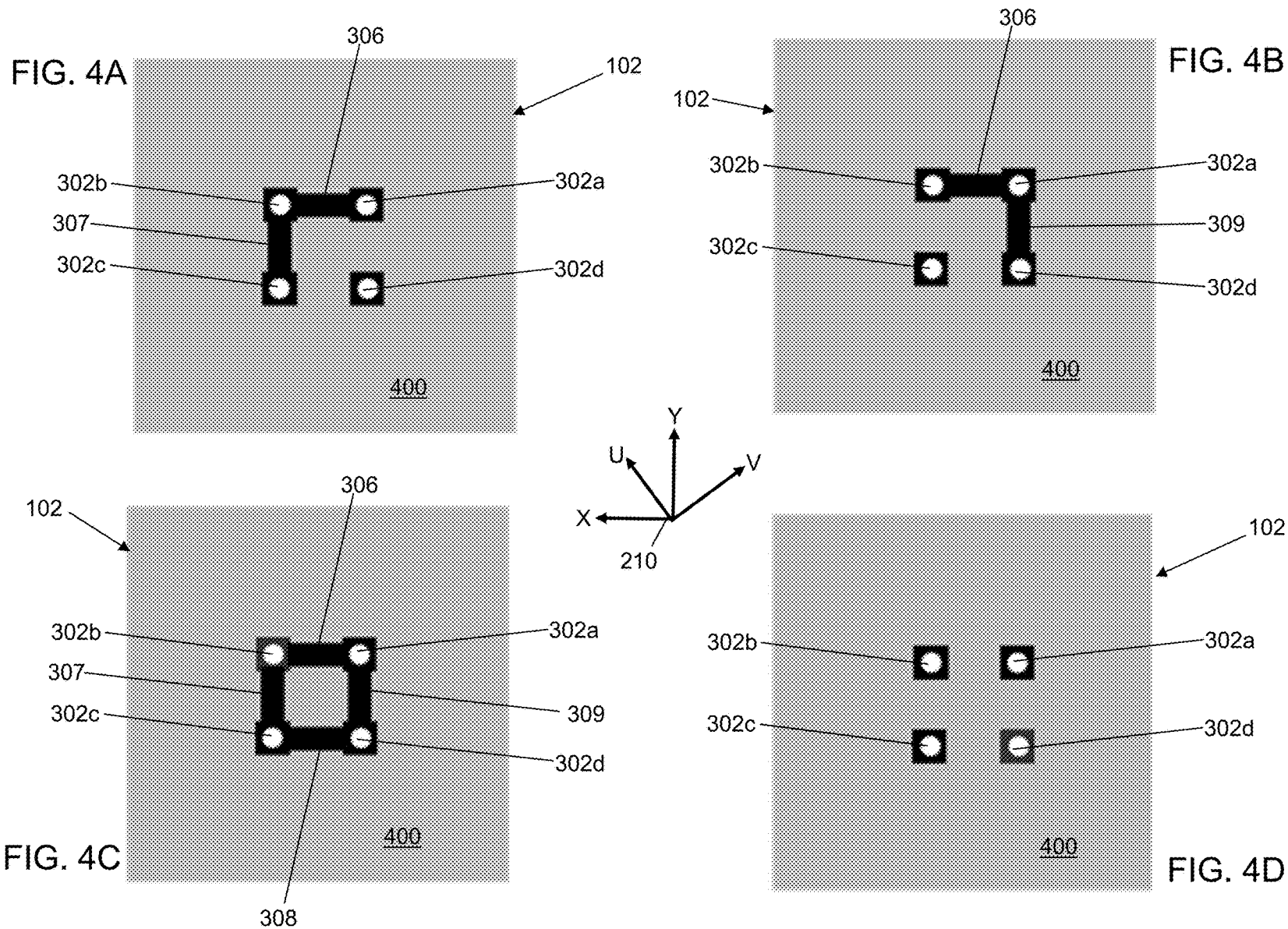
FIGS. 4A to 4D depict bottom views of the 2-bit phase shift element of FIG. 1 with switches arranged to define a first mode, a second mode, a third mode, and a fourth mode, respectively, in accordance with an illustrative embodiment.
Figure 4E:
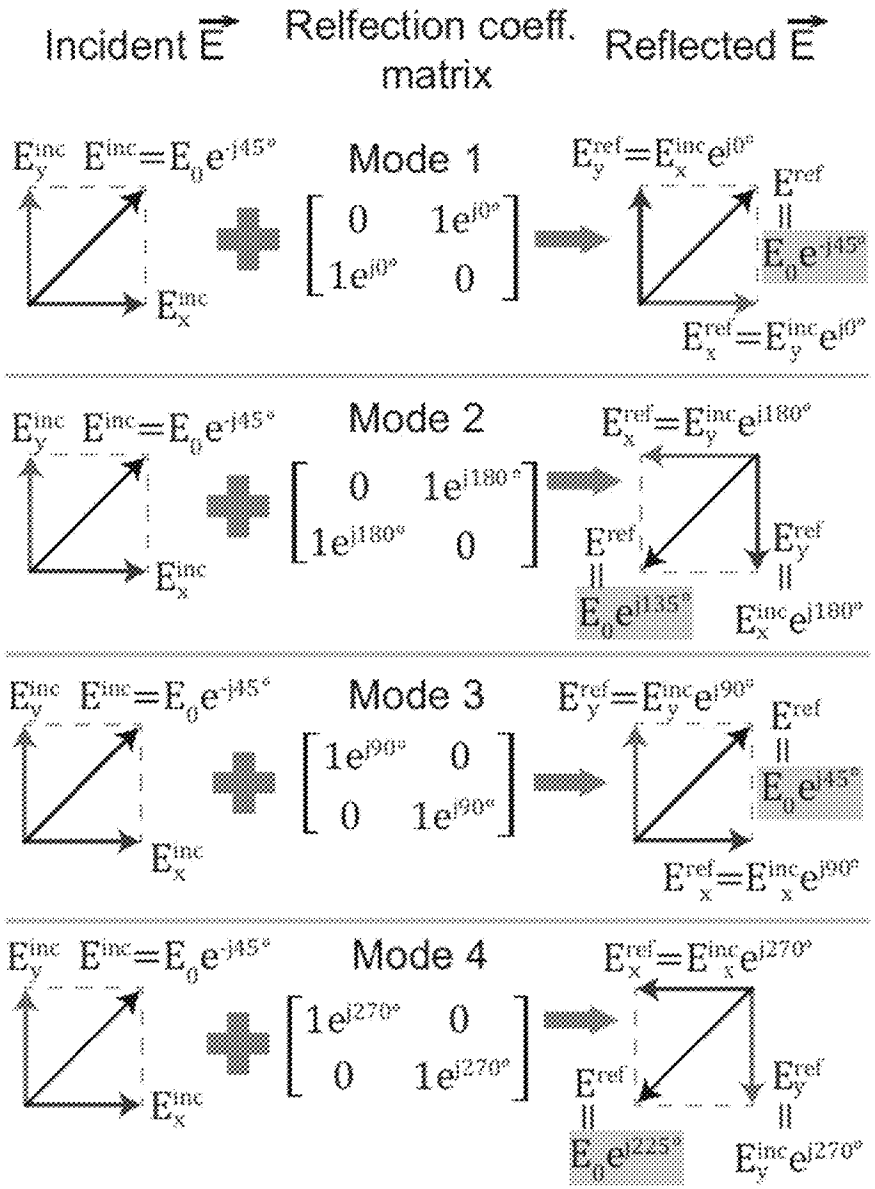
FIG. 4E illustrates an incident electric wave and a corresponding reflected electric wave generated based on the operating mode of the switches of FIGS. 4A to 4D in accordance with an illustrative embodiment.

When only first throw arm 306 of the first switch and second throw arm 307 of the second switch are in the first position as shown in FIG. 4A, 2-bit phase shift element 100 may be designated as in a "bit 00" configuration also referred to as the first configuration defined by first switch positions, as a first mode, or as a first phase state of 2-bit phase shift element 100. When only first throw arm 306 of the first switch and fourth throw arm 309 of the fourth switch are in the first position as shown in FIG. 4B, 2-bit phase shift element 100 may be designated as in a "bit 11" configuration also referred to as the second configuration defined by second switch positions, as a second mode, or as a second phase state of 2-bit phase shift element 100. When first throw arm 306 of the first switch, second throw arm 307 of the second switch, third throw arm 308 of the third switch, and fourth throw arm 309 of the fourth switch are all in the first position as shown in FIG. 4C, 2-bit phase shift element 100 may be designated as in a "bit 01" configuration also referred to as the third configuration defined by third switch positions, as a third mode, or as a third phase state of 2-bit phase shift element 100. When first throw arm 306 of the first switch, second throw arm 307 of the second switch, third throw arm 308 of the third switch, and fourth throw arm 309 of the fourth switch are all in the second position as shown in FIG. 4D, 2-bit phase shift element 100 may be designated as in a "bit 10" configuration also referred to as the fourth configuration defined by fourth switch positions, as a fourth mode, or as a fourth phase state of 2-bit phase shift element 100. Of course, the modes can be defined in other manners to distinguish the four operating modes of 2-bit phase shift element 100.

A combined electrical path length of first connecting arm 128*a* and first via 302*a* is approximately $\lambda_0/4$ (a quarter of the wavelength) and includes arm length 208 that defines a length of first connecting arm 128*a* and third thickness 118, third thickness 117, and third thickness 116 that define a length of first via 302*a*. Similarly, a combined electrical path length of second connecting arm 128*b* and second via 302*b* is approximately $\lambda_0/4$. Similarly, a combined electrical path length of third connecting arm 128*c* and third via 302*c* is approximately $\lambda_0/4$. Similarly, a combined electrical path length of fourth connecting arm 128*d* and fourth via 302*d* is approximately $\lambda_0/4$. $\lambda_0$ is the wavelength in free space at the frequency of operation.

An electrical path length of each of first throw arm 306 of the first switch, second throw arm 307 of the second switch, third throw arm 308 of the third switch, and fourth throw arm 309 of the fourth switch can be set in the range from $\lambda_0/100$ to $\lambda_0/5$ (e.g. based on a range of physical dimensions of several commercial electronic switches and PIN diodes). The electrical path length for the currents is included in a total electrical path length for each connected pair of arms (e.g., first connecting arm 128*a* and first via 302*a* connected to second via 302*b* and second connecting arm 128*b* by first throw arm 306 of the first switch) when connected by a throw arm of one of the switches. The total electrical path length of each connected pair of arms is approximately half a wavelength.

Referring to FIG. 4E, a reflection coefficient matrix includes four elements describing the transfer coefficients from an incident electric field (having either an x- or y-polarization) to a reflected electric field (having either an x- or y-polarization). Among the four reflection modes, two modes represent polarization rotation operation (e.g., $|R_{xy}|=|R_{yx}|=1$) with relative reflection phase values of 0° and 180°. The other two modes represent non-polarization-rotation operation (e.g., $|R_{xx}|=|R_{yy}|=1$) with relative phase values of 90° and 270°. These four reflection modes provide reflected waves having the same polarization and four phase states with a 90° progression when 2-bit phase shift element 100 is illuminated with an incident wave polarized along either of its two diagonal directions. 2-bit phase shift element 100 provides 2-bit phase quantization by exploiting the four distinct reflection modes. These four reflection modes can be characterized by the corresponding reflection coefficient matrices $$R^{(1)} = \begin{bmatrix} R_{xx} & R_{xy} \\ R_{yx} & R_{yy} \end{bmatrix} = \begin{bmatrix} 0 & 1e^{j0°} \\ 1e^{j0°} & 0 \end{bmatrix},$$

$$R^{(2)} = \begin{bmatrix} R_{xx} & R_{xy} \\ R_{yx} & R_{yy} \end{bmatrix} = \begin{bmatrix} 0 & 1e^{j180°} \\ 1e^{j180°} & 0 \end{bmatrix},$$

$$R^{(3)} = \begin{bmatrix} R_{xx} & R_{xy} \\ R_{yx} & R_{yy} \end{bmatrix} = \begin{bmatrix} 1e^{j90°} & 0 \\ 0 & 1e^{j90°} \end{bmatrix},$$

$$R^{(4)} = \begin{bmatrix} R_{xx} & R_{xy} \\ R_{yx} & R_{yy} \end{bmatrix} = \begin{bmatrix} 1e^{j270°} & 0 \\ 0 & 1e^{j270°} \end{bmatrix},$$

where $R^{(1)}$ is the reflection coefficient matrix for the first mode, $R^{(2)}$ is the reflection coefficient matrix for the second mode, $R^{(3)}$ is the reflection coefficient matrix for the third mode, and $R^{(4)}$ is the reflection coefficient matrix for the fourth mode.

In $R^{(1)}$, $R^{(2)}$, $R^{(3)}$, and $R^{(4)}$, $$R_{ij} = \frac{E_i^{ref}}{E_j^{inc}},$$

where $E_i^{ref}$ is the reflected electric field intensity along the i direction, and $E_j^{inc}$ is the incident electric field intensity along the j direction (i,j=x or y). When illuminated with an incident wave polarized along the x-axis or the y-axis, 2-bit phase shift element 100 switched into one of the first two reflection modes (Mode 1 (the first mode) and Mode 2 (the second mode)) rotates the polarization of the reflected field by +90° and −90° with respect to that of the incident electric field, creating a 180° phase difference in the reflected electric field in these two modes of operation. The polarization rotation operation of these two modes are characterized by $|R_{xy}^{(1)}|=|R_{yx}^{(1)}|=|R_{xy}^{(2)}|=|R_{yx}^{(2)}|=1$ and $|R_{xx}^{(1)}|=|R_{yy}^{(1)}|=|R_{xx}^{(2)}|=|R_{yy}^{(2)}|=0$.

In the other two reflection modes (Mode 3 (the third mode) and Mode 4 (the fourth mode)), 2-bit phase shift element 100 maintains the polarization of the reflected electric field with respect to the x-polarized or y-polarized incident field due to $|R_{xy}^{(3)}|=|R_{yx}^{(3)}|=|R_{xy}^{(4)}|=|R_{yx}^{(4)}|=0$ and $|R_{xx}^{(3)}|=|R_{yy}^{(3)}|=|R_{xx}^{(3)}|=|R_{yy}^{(3)}|=1$ and provides a phase difference of 180° between the reflected electric fields of these two modes. Additionally, the phase difference between the corresponding dominant reflection coefficients of a polarization-rotating mode (e.g, $R_{xy}^{(1)}$, $R_{yx}^{(1)}$, $R_{xy}^{(2)}$, or $R_{yx}^{(2)}$) and a non-polarization-rotating mode (e.g., $R_{xx}^{(3)}$, $R_{yy}^{(3)}$, $R_{xx}^{(4)}$, or $R_{yy}^{(4)}$) is either 90° or 270°.

2-bit phase shift element 100 having these four reflection modes can provide 2-bit phase quantization for the reflected electric fields when illuminated with an incident electric field polarized along the direction of $$\hat{u} = \frac{1}{\sqrt{2}}(\hat{x} + \hat{y})$$

or $$\hat{v} = \frac{1}{\sqrt{2}}(-\hat{x} + \hat{y}).$$

Assuming the incident electric field vector has the form $\vec{E}^{inc}=\hat{u}E_0e^{j\Phi}=\hat{x}E_x^{inc}+\hat{y}E_y^{inc}$, where $$E_x^{inc} = E_y^{inc} = \frac{1}{\sqrt{2}}E_0e^{j\Phi},$$

the reflected electric field vector produced by 2-bit phase shift element 100 in the four modes of operation can be written as follows:

$$\vec{E}^{ref,(1)} = \hat{x}E_y^{inc}R_{xy}^{(1)} + \hat{y}E_x^{inc}R_{yx}^{(1)} = \frac{1}{\sqrt{2}}E_0e^{j\Phi}e^{j0°}(\hat{x} + \hat{y}) = E_0e^{j\Phi}\hat{u}, \quad (1)$$

$$\vec{E}^{ref,(2)} = \hat{x}E_y^{inc}R_{xy}^{(2)} + \hat{y}E_x^{inc}R_{yx}^{(2)} = \frac{1}{\sqrt{2}}E_0e^{j\Phi}e^{j180°}(\hat{x} + \hat{y}) = E_0e^{j(\Phi+180°)}\hat{u}, \quad (2)$$

-continued $$\vec{E}^{ref,(3)} = \hat{x}E_y^{inc}R_{xx}^{(3)} + \hat{y}E_x^{inc}R_{yy}^{(3)} = \frac{1}{\sqrt{2}}E_0e^{j\Phi}e^{j90°}(\hat{x} + \hat{y}) = E_0e^{j(\Phi+90°)}\hat{u}, \quad (3)$$

$$\vec{E}^{ref,(4)} = \hat{x}E_y^{inc}R_{xx}^{(4)} + \hat{y}E_x^{inc}R_{yy}^{(4)} = \frac{1}{\sqrt{2}}E_0e^{j\Phi}e^{j270°}(\hat{x} + \hat{y}) = E_0e^{j(\Phi+270°)}\hat{u}. \quad (4)$$

Equations (1)-(4) show that the reflected electric fields are polarized along the u-axis in all four cases with the relative phase values of 0° (Mode 1), 90° (Mode 3), 180° (Mode 2), and 270° (Mode 4). Therefore, the four operating modes or phase states of 2-bit phase shift element 100 provide a 2-bit phase quantization for the reflected electromagnetic field.

FIG. 4E illustrates the operation of the four reflection modes in their interaction with the incident, linearly-polarized electric field $\vec{E}^{inc}=\hat{u}E_0e^{j\Phi}$, where Φ may be chosen to be −45° for convenience. Mode 1 rotates the x-component and the y-component of the incident electric field into the y-component and the x-component of the reflected electric field, respectively, with a 0° phase shift. As a result, the total reflected electric field vector is the same as the total incident electric field vector. Mode 2 also rotates the x-component and the y-component of the incident electric field into the y-component and the x-component of the reflected electric field, respectively, but with a 180° phase shift, providing the total reflected field vector in the opposite direction of the incident electric field vector. As a result, Modes 1 and 2 create two relative phase values of 0° and 180°.

Mode 3 reflects the x-component and the y-component of the incident electric field with the same polarization and a 90° phase shift. Mode 4 reflects the x-component and the y-component of the incident electric field with the same polarization and a 270° phase shift. Since the phase shifts added to the reflected electric field component in the x-component and the y-component are equal in the third mode and the fourth mode, the resulting reflected electric field maintains its polarization along the u-axis like the incident field. However, the phase leads by the reflected electric fields of 90° and 270° in Modes 3 and 4, respectively, compared to that in Mode 1. Therefore, the four reflection modes provide reflected fields having the same polarization along the u-axis with relative phase values of 0°, 90°, 180°, and 270° creating 2-bit phase shifts.

The four reflection modes of 2-bit phase shift element 100 are defined by four configurations of the switches as shown in FIGS. 4A to 4D. When three of the vias are electrically connected to each other using two ON switches (shown as Mode 1 in FIG. 4A or Mode 2 in FIG. 4B by first throw arm 306 of the first switch being closed and either second throw arm 307 of the second switch being closed or fourth throw arm 309 of the fourth switch being closed), 2-bit phase shift element 100 acts as a polarization rotator when illuminated with an incident wave having linear polarization along the x-axis or y-axis. When a corner conductor 124*a*, 124*b*, 124*c*, 124*d* is connected to another corner conductor 124*a*, 124*b*, 124*c*, 124*d* as shown in either FIG. 4A or FIG. 4B, the respective corner conductors are deactivated. When a corner conductor 124*a*, 124*b*, 124*c*, 124*d* is not connected to another corner conductor 124*a*, 124*b*, 124*c*, 124*d*, the respective corner conductors are activated for polarization rotation operation. Each activated corner conductor 124*a*, 124*b*, 124*c*, 124*d* allows strong induced electrical currents to flow on a respective connecting arm 128*a*, 128*b*, 128*c*, 128*d* along a diagonal line of 2-bit phase shift element 100 when it is illuminated with an x-polarized or y-polarized incident wave. If the induced currents are strong along only one diagonal line, 2-bit phase shift element 100 presents a perfect electrical conductor (PEC)-like reflection along this diagonal line and a perfect magnetic conductor (PMC)-like reflection along the perpendicular direction. As a result, the polarization of the reflected wave is rotated by 90° or −90° with respect to the incident wave, depending on which diagonal line has the strong induced currents. These opposite rotation directions create reflected electric field vectors in reversed directions representing a phase difference of 180° in the reflected wave. In Mode 1, the isolated corner conductor is fourth corner conductor 124*d*. In Mode 2, the isolated corner conductor is third corner conductor 124*c* making Modes 1 and 2 orthogonal to each other.

On the other hand, connecting or isolating all four corner conductors 124*a*, 124*b*, 124*c*, 124*d*, as shown for Modes 3 and 4 in FIGS. 4C and 4D, respectively, deactivates the polarization rotation operation of 2-bit phase shift element 100. 2-bit phase shift element 100 in these two modes reflects an x-polarized or y-polarized incident wave while maintaining the same polarization. Moreover, due to rotational symmetry of the connections for Mode 3 or Mode 4, the reflection coefficients $R_{xx}$ and $R_{yy}$ have the same phases and amplitudes. A phase difference of 180° in the co-polarization reflection coefficients of the two non-polarization rotating modes can be achieved by having strong induced currents in both diagonal directions in one mode (Mode 4) while having weak induced currents in both diagonal directions in the other mode (Mode 3). 2-bit phase shift element 100 acts more like a PEC surface in the mode (Mode 4) with strong currents and more like a PMC surface in the mode (Mode 3) with weak currents.

2-bit phase shift element 100 was simulated using the unit cell boundary condition in CST Microwave Studio. 2-bit phase shift element 100 was constructed using three Rogers 4003C substrates bonded together by two layers of Rogers 4450F prepreg. 2-bit phase shift element 100 had a periodicity of 12 millimeters (mm) and was designed to operate at X band. The feature dimensions were tuned to result in four reflection modes that were as close as possible to those characterized by $R^{(1)}$, $R^{(2)}$, $R^{(3)}$, and $R^{(4)}$ at 10 GHz. Subsequently, the conditions on the amplitudes and phases of the reflection coefficients were relaxed and the feature dimensions were further tuned to expand the operating bandwidth as much as possible. The relaxed conditions were defined such that the dominant reflection coefficients of each mode had magnitudes of no less than −1 dB and phases within ±15° of the desired phase value. Since the four desired (relative) phase states are 0°, 90°, 180°, and 270°, the relaxed phase condition means that the difference between two consecutive phase state is within the range of 60°-120°.

Illustrative dimensions for 2-bit phase shift element 100 were P=12 millimeters (mm) for length 120 and width 121, $l_1$=6.5 mm for arm length 208, $w_1$=1.2 mm for arm width 206, $l_2$=4.9 mm for corner arm length 202, $w_2$=2.0 mm for corner arm width 204, s=0.4 mm for first distance 200, $h_1$=0.81 mm for third thickness 118, and $h_2$=1.52 mm for first thickness 116 of first dielectric layer 102. For illustration, second 2-bit phase shift element 600 can be fabricated using printed circuit board technology. The thickness of the conductive layers may vary based on the laminates used. For example, standard thicknesses for conductive layers of Rogers laminates are 0.017 mm, 0.035 mm, and 0.07 mm. The prototypes fabricated and simulated used copper layers with a thickness of 0.035 mm.

Figure 5A:
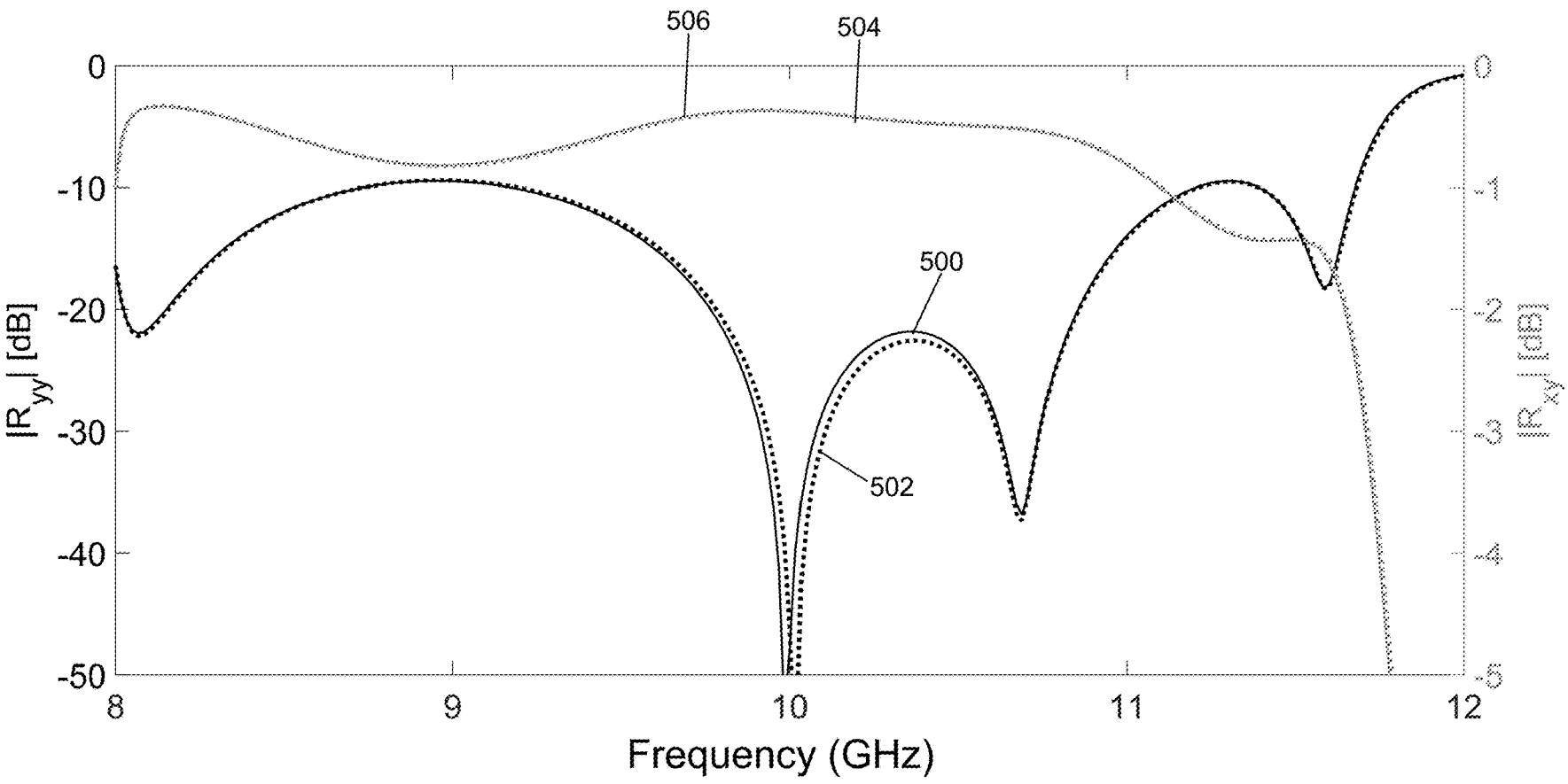
FIG. 5A depicts simulated y-y and x-y reflection coefficients generated by the 2-bit phase shift element of FIG. 1 operating in the first mode and operating in the second mode in accordance with an illustrative embodiment.

Referring to FIG. 5A, simulation results for the magnitudes of the reflection coefficients $R_{yy}$ and $R_{xy}$ are shown for Modes 1 and 2 in accordance with the illustrative embodiment. An $R_{yy}$ reflection coefficient curve 500 for Mode 1 and an $R_{yy}$ reflection coefficient curve 502 for Mode 2 are shown relative to the left axis as a function of frequency. An $R_{xy}$ reflection coefficient curve 504 for Mode 1 and an $R_{xy}$ reflection coefficient curve 506 for Mode 2 are shown relative to the right axis as a function of frequency. The polarization rotation behavior in these two modes is shown by a high $R_{xy}$ ($|R_{xy}|>-1$ decibels (dB)) and a low $R_{yy}$ ($|R_{yy}|<-10$ dB) over the frequency range from 9.1 GHz to 11.1 GHz.

Figure 5B:
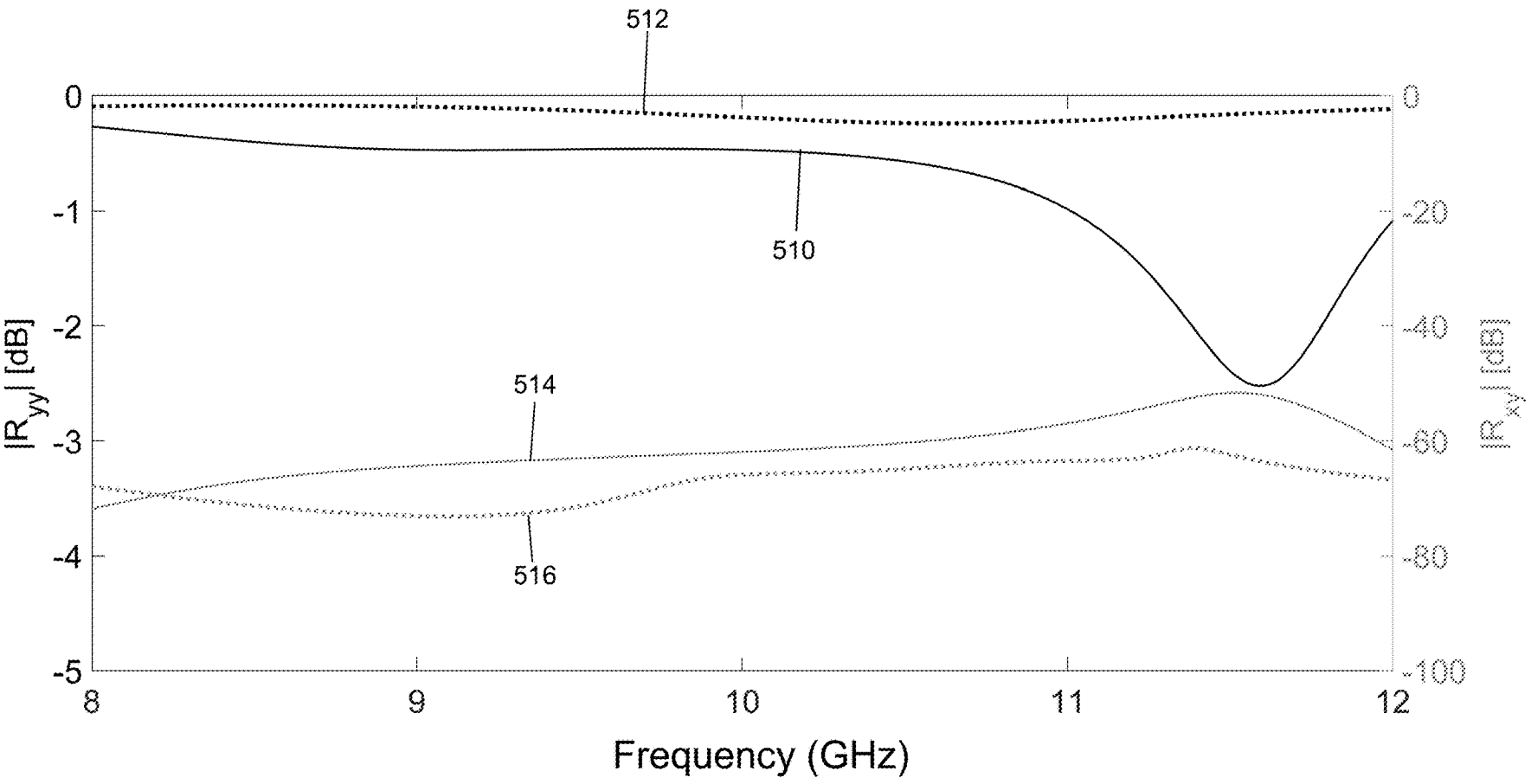
FIG. 5B depicts simulated y-y and x-y reflection coefficients generated by the 2-bit phase shift element of FIG. 1 operating in the third mode and operating in the fourth mode in accordance with an illustrative embodiment.

Referring to FIG. 5B, simulation results for the magnitudes of the reflection coefficients $R_{yy}$ and $R_{xy}$ are shown for Modes 3 and 4 in accordance with the illustrative embodiment. An $R_{yy}$ reflection coefficient curve 510 for Mode 3 and an $R_{yy}$ reflection coefficient curve 512 for Mode 4 are shown relative to the left axis as a function of frequency. An $R_{xy}$ reflection coefficient curve 514 for Mode 3 and an $R_{xy}$ reflection coefficient curve 516 for Mode 4 are shown relative to the right axis as a function of frequency. In contrast to the two polarization-rotating modes, $R_{xy}$ is small ($|R_{xy}|<-68$ dB) and $R_{yy}$ is high ($|R_{yy}|>-1$ dB) over the frequency range from 8.0 GHz to 11.0 GHz.

Figure 5C:
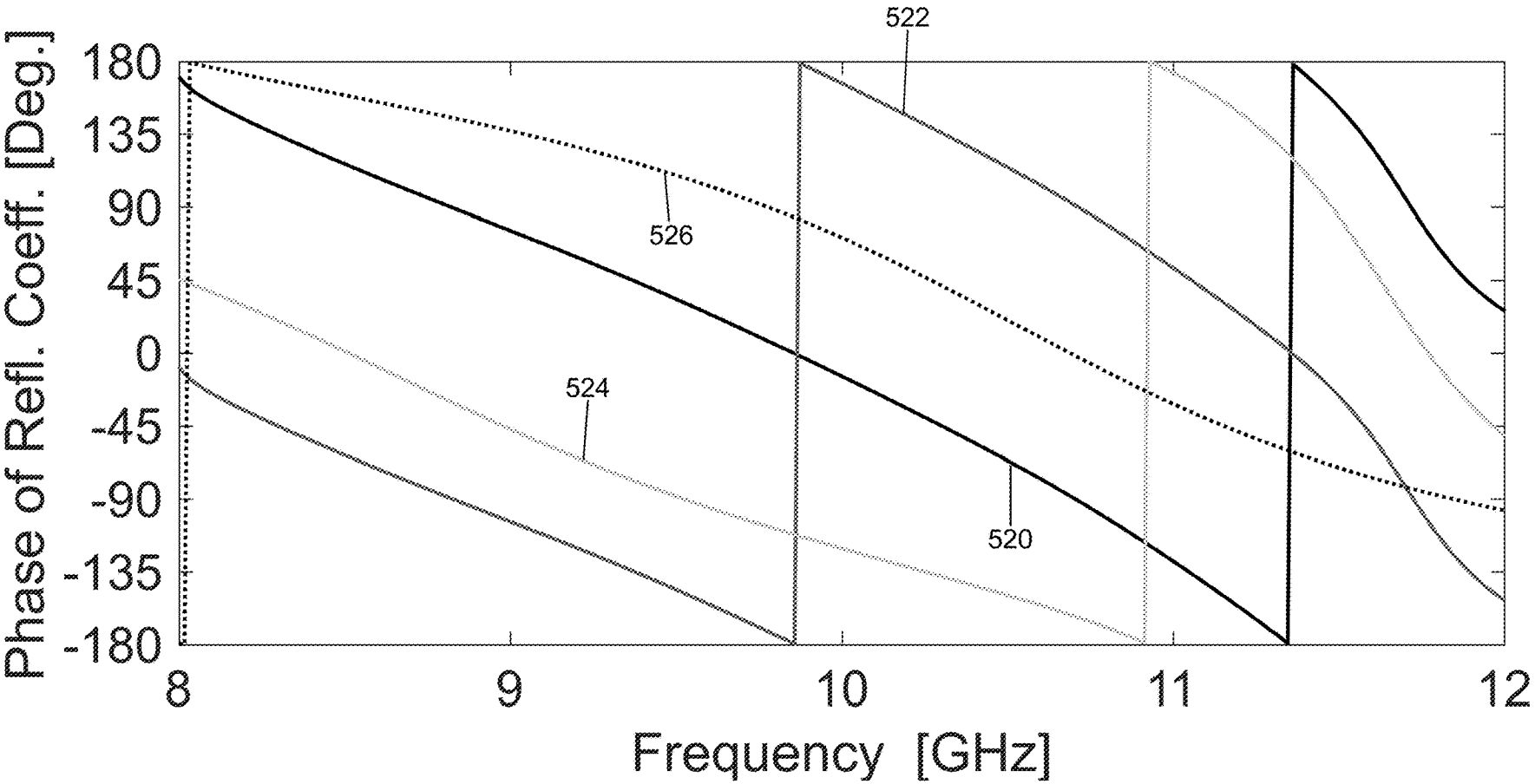
FIG. 5C depicts simulated phases of the y-y and x-y reflection coefficients generated by the 2-bit phase shift element of FIG. 1 operating in the first mode, the second mode, the third mode, and the fourth mode in accordance with an illustrative embodiment.

Referring to FIG. 5C, simulation results are shown for the phases of $R_{xy}$ for Modes 1 and 2 and for the phases of $R_{yy}$ for Modes 3 and 4 in accordance with the illustrative embodiment. An $R_{xy}$ phase curve 520 for Mode 1, an $R_{xy}$ phase curve 522 for Mode 2, an $R_{yy}$ phase curve 524 for Mode 3, and an $R_{yy}$ phase curve 526 for Mode 4 are shown as a function of frequency. Four distinctive phase values, referenced to the phase of $R_{xy}$ of Mode 1, are quite close to 0°, 90°, 180°, and 270° (or −90°) at 10 GHz. The response of 2-bit phase shift element 100 in all four modes is symmetric for x-polarized and y-polarized incident waves meaning $R_{xy}=R_{yx}$ and $R_{xx}=R_{yy}$.

Figure 6A:
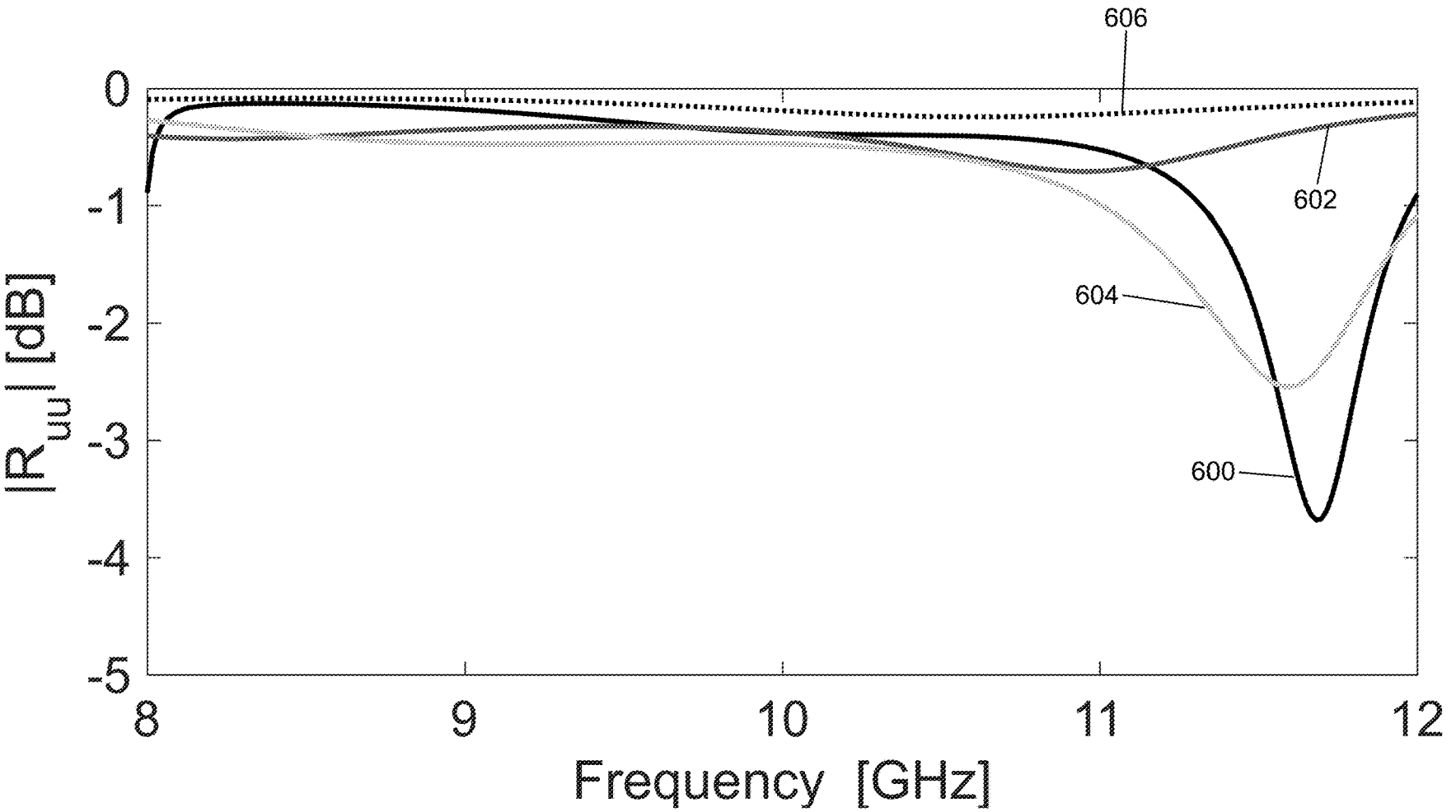
FIG. 6A depicts simulated u-u reflection coefficients generated by the 2-bit phase shift element of FIG. 1 operating in the first mode, the second mode, the third mode, and the fourth mode in accordance with an illustrative embodiment.

Subsequently, reflection coefficients of 2-bit phase shift element 100 in the four modes were evaluated in simulations for the case where the incident wave is polarized along the u-axis. Referring to FIG. 6A, simulation results for the magnitudes of the reflection coefficients $R_{uu}$ are shown for Modes 1 through 4 in accordance with the illustrative embodiment. An $R_{uu}$ reflection coefficient curve 600 for Mode 1, an $R_{uu}$ reflection coefficient curve 602 for Mode 2, an $R_{uu}$ reflection coefficient curve 604 for Mode 3, and an $R_{uu}$ reflection coefficient curve 606 are shown as a function of frequency.

Figure 6B:
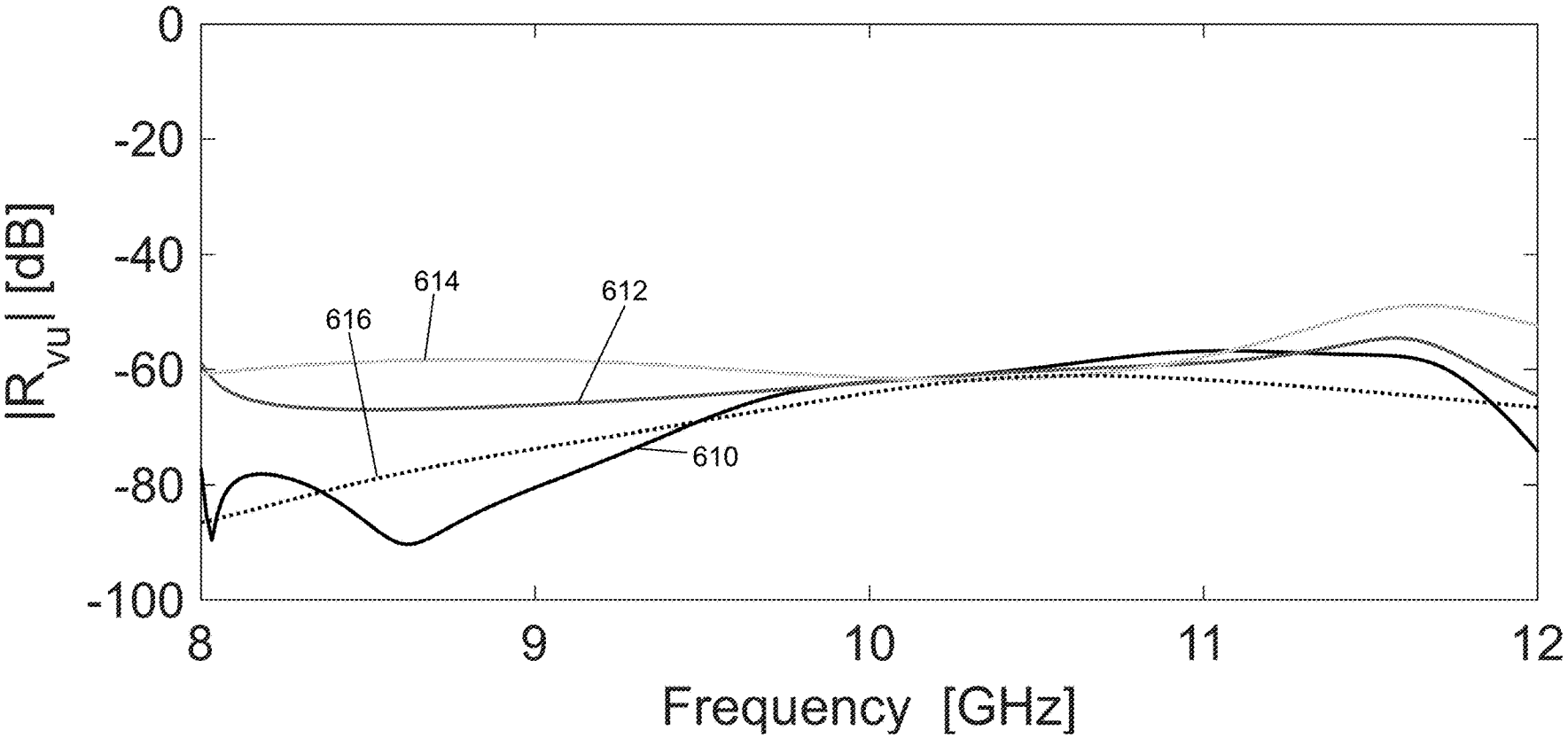
FIG. 6B depicts simulated u-v reflection coefficients generated by the 2-bit phase shift element of FIG. 1 operating in the first mode, the second mode, the third mode, and the fourth mode in accordance with an illustrative embodiment.

Referring to FIG. 6B, simulation results for the magnitudes of the reflection coefficients $R_{vu}$ are shown for Modes 1 through 4 in accordance with the illustrative embodiment. An $R_{vu}$ reflection coefficient curve 610 for Mode 1, an $R_{vu}$ reflection coefficient curve 612 for Mode 2, an $R_{vu}$ reflection coefficient curve 614 for Mode 3, and an $R_{uu}$ reflection coefficient curve 616 are shown as a function of frequency.

Figure 6C:
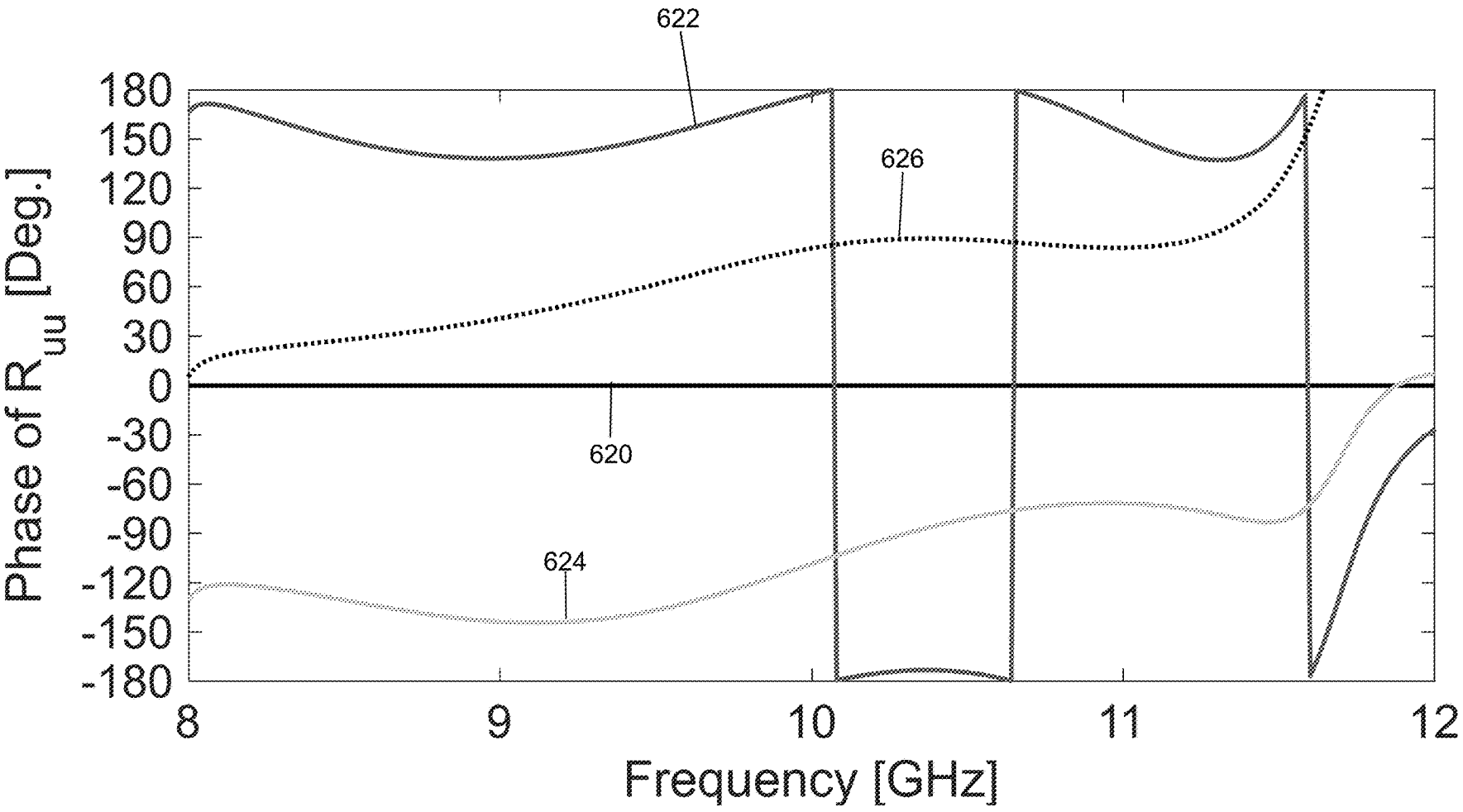
FIG. 6C depicts simulated phases of the u-u reflection coefficients generated by the 2-bit phase shift element of FIG. 1 operating in the first mode, the second mode, the third mode, and the fourth mode in accordance with an illustrative embodiment.

Referring to FIG. 6C, simulation results for the phases of $R_{uu}$ for Modes 1 through 4 are shown in accordance with the illustrative embodiment where the phase of Mode 1 is taken as the reference. An $R_{uu}$ phase curve 620 for Mode 1, an $R_{uu}$ phase curve 622 for Mode 2, an $R_{uu}$ phase curve 624 for Mode 3, and an $R_{uu}$ phase curve 626 for Mode 4 are shown as a function of frequency. As expected from equations (1) to (4), all four modes provide reflected waves with a dominant polarization along the u-axis. Specifically, the co-polarization reflection coefficient $R_{uu}$ has a magnitude ≥−1 dB, and the cross-polarization reflection $R_{vu}$ has a magnitude ≤−57 dB from 9.0 GHz to 11.7 GHz. At 10

GHz, the phase values for the four reflection modes are 0°, 88°, 203° (−157), and 281° (−79°). Using the phase values of the four modes results in an equivalent bit number of 1.91 bits at 9.5 GHz, 1.94 bits at 10.0 GHz, and 1.92 bits at 10.5 GHz. The equivalent bit number is greater than or equal to 1.7 bits over the frequency range of 9.0-11.5 GHz. The operating frequency range for the 2 bit phase shift element 100 was determined to be from 9.0 GHz to 11.0 GHz, over which the phase resolution is not less than 1.7 bits, and the co-polarization reflection coefficients $R_{uu}$ for all four modes is not less than −1 dB.

Figure 7:
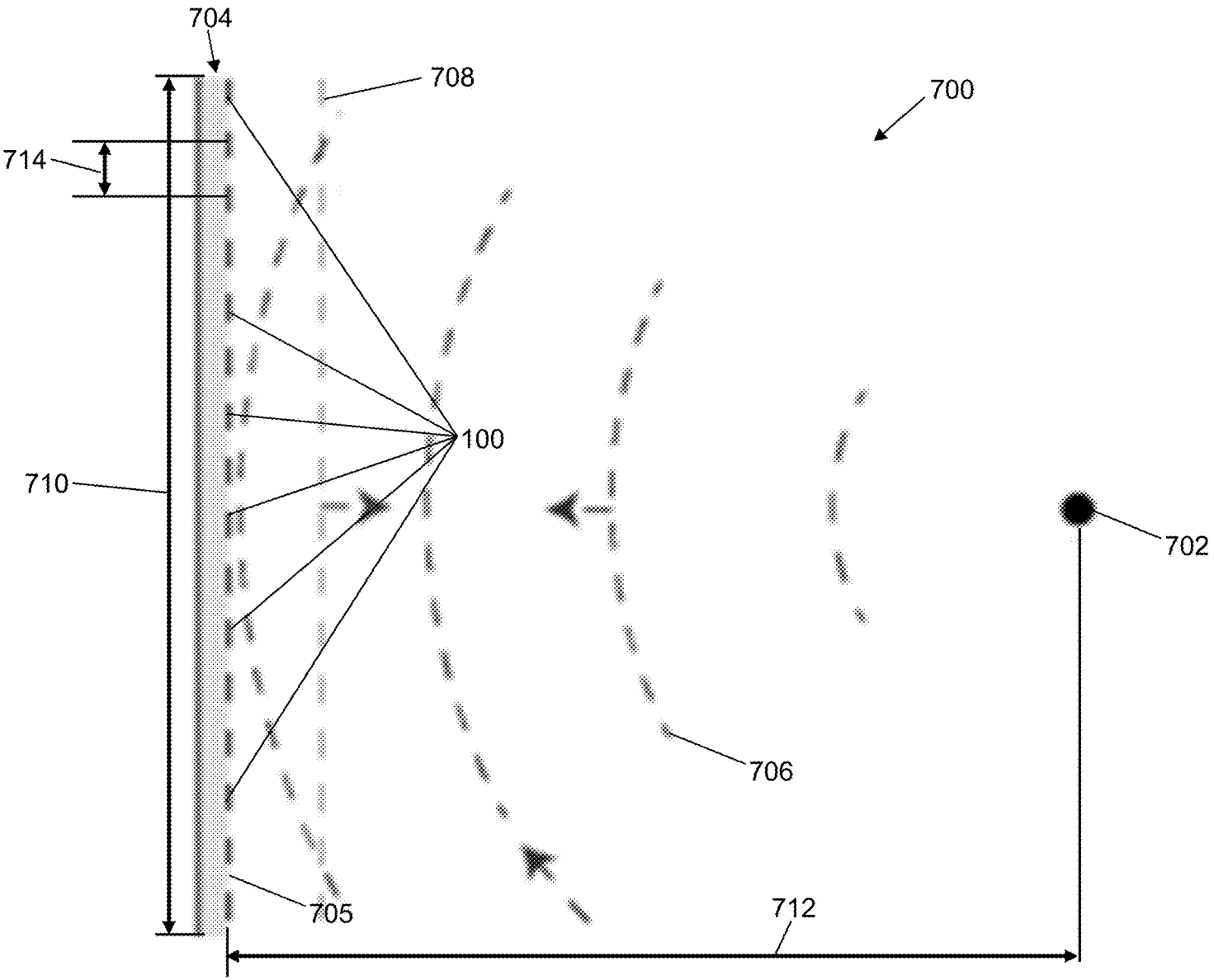
FIG. 7 depicts a side view of a transceiver system that includes the 2-bit phase shift element of FIG. 1 in accordance with an illustrative embodiment.

Referring to FIG. 7, a 1-D side view of a transceiver system 700 is shown in accordance with an illustrative embodiment. Transceiver system 700 may include a feed antenna 702 and a plurality of 2-bit phase shift elements. Transceiver system 700 may act as a transmitter or a receiver of analog or digital signals. The plurality of 2-bit phase shift elements is arranged to form a reflective array antenna 704. Feed antenna 702 may have a low gain. Feed antenna 702 may be a dipole antenna, a monopole antenna, a helical antenna, a microstrip antenna, a patch antenna, a fractal antenna, a feed horn, a slot antenna, an end fire antenna, a parabolic antenna, etc. Feed antenna 702 is positioned a focal distance 712, fa, from a front face 705 of the plurality of 2-bit phase shift elements. Feed antenna 702 is configured to receive an analog or a digital signal, and in response, to radiate a spherical radio wave 706 toward front face 705 of the plurality of 2-bit phase shift elements. For example, front face 705 may include conducting pattern layer 107 of each 2-bit phase shift element. Feed antenna 702 also may be configured to receive spherical radio wave 706 from front face 705 of the plurality of 2-bit phase shift elements and to generate an analog or a digital signal in response.

The plurality of 2-bit phase shift elements may be arranged to form a one-dimensional (1D) or a two-dimensional (2D) array of spatial phase shift elements in any direction. The plurality of 2-bit phase shift elements may form variously shaped apertures including circular, rectangular, square, elliptical, etc. The plurality of 2-bit phase shift elements can include any number of 2-bit phase shift elements.

Figure 8:
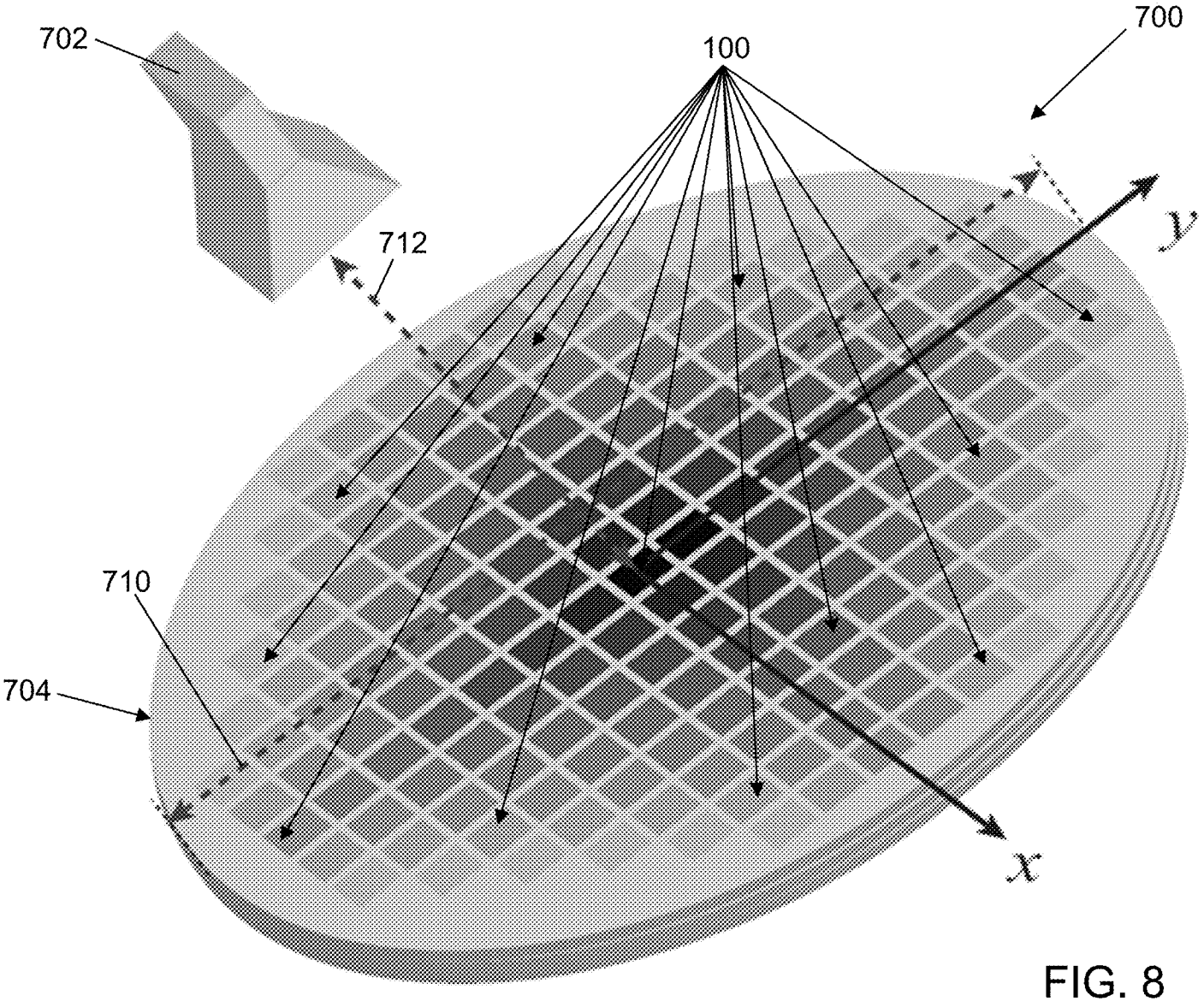
FIG. 8 depicts a perspective view of the transceiver system of FIG. 7 in accordance with an illustrative embodiment.

Referring to FIG. 8, a perspective view of transceiver system 700 is shown with a circular aperture. Feed antenna 702 is illustrated as a feed horn and is positioned at a center of reflective array antenna 704. The plurality of 2-bit phase shift elements are arranged to form a circular 2-D array of 2-bit phase shift elements. The plurality of 2-bit phase shift elements has an aperture length 710.

Spherical radio wave 706 reaches different portions of front face 705 at different times. The plurality of 2-bit phase shift elements can be considered to be a plurality of pixels each of which act as a 2-bit phase shift unit by providing a selected phase shift within the frequency band of interest. Thus, each 2-bit phase shift element of the plurality of 2-bit phase shift elements acts as a phase shift circuit selected such that spherical radio wave 706 is re-radiated in the form of a planar wave 708 that is parallel to front face 705, or vice versa. Given aperture length 710 and focal distance 712, the phase shift profile provided for the plurality of 2-bit phase shift elements to form planar wave 708 directed to a specific angle can be calculated as understood by a person of skill in the art. Center 134 of each 2-bit phase shift element is separated a distance 714 from center 134 of its neighbors in any direction. Distance 714 may be equal to length 120 and width 121.

For example, assuming feed antenna 702 is aligned to emit spherical radio wave 706 at the focal point of the plurality of 2-bit phase shift elements, the time it takes for each ray to arrive at front face 705 is determined by a length of each ray trace, i.e., the distance traveled by the electromagnetic wave traveling at the speed of light. A minimum time corresponds to a propagation time of the shortest ray trace, which is the line path from feed antenna 702 to a center of front face 705 for a center positioned feed antenna 702. A maximum time corresponds to a propagation time of the longest ray trace, which is the line path from feed antenna 702 to an edge of front face 705 for the center positioned feed antenna 702. Feed antenna 702 may be positioned at an off-center position with a resulting change in the distribution of ray traces to each 2-bit phase shift element. Of course, because the distance varies between feed antenna 702 and each 2-bit phase shift element of reflective array antenna 704, a magnitude of the portion of spherical radio wave 706 received by each 2-bit phase shift element also varies.

Figure 9A:
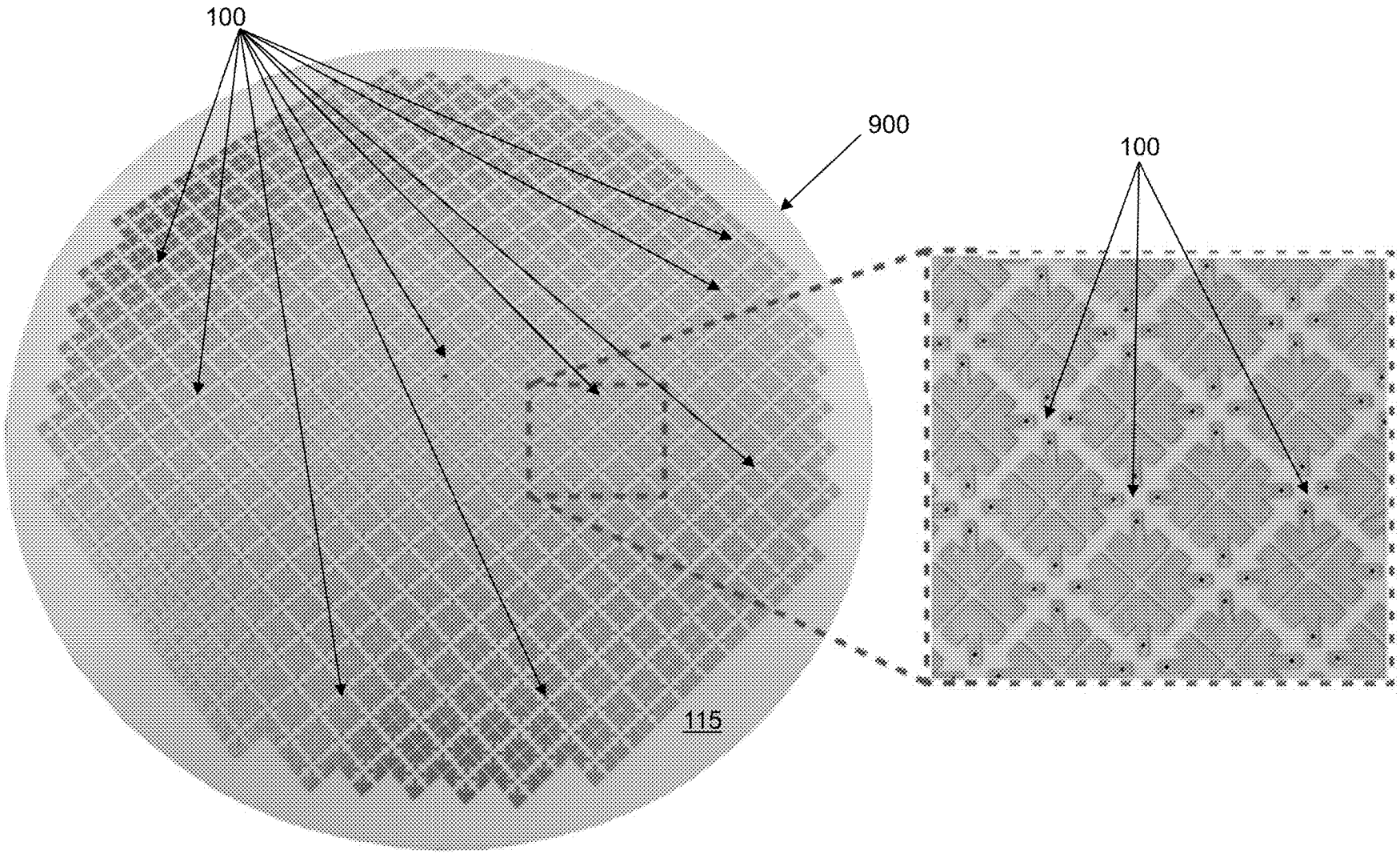
FIG. 9A depicts a front perspective view of a fabricated phased array antenna of the transceiver system of FIG. 7 in accordance with an illustrative embodiment.
Figure 9B:
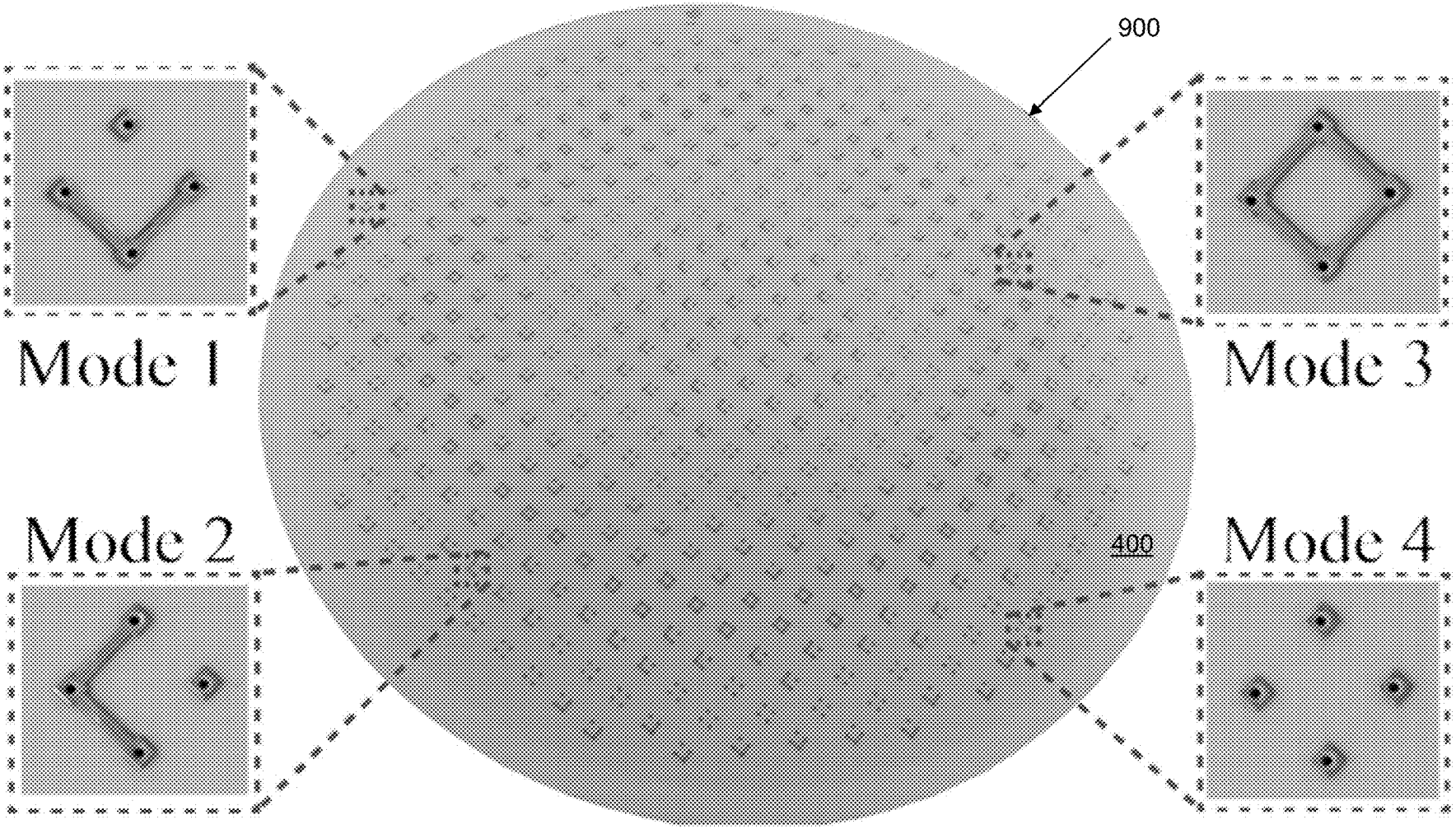
FIG. 9B depicts a back perspective view of the fabricated phased array antenna of the transceiver system of FIG. 7 in accordance with an illustrative embodiment.

Referring to FIG. 9A, a top perspective view of a fabricated reflective array antenna 900 having a circular aperture is shown in accordance with an illustrative embodiment. Referring to FIG. 9B, a bottom perspective view of fabricated reflective array antenna 900 is shown in accordance with an illustrative embodiment to illustrate a distribution pattern of the switch position of the 2-bit phase shift elements of FIG. 9A arranged on bottom surface 400 of first dielectric layer 102 to achieve a beam collimation in the broadside direction. Fabricated reflective array antenna 900 includes 484 2-bit phase shift elements distributed to form a circular 2-D aperture. A second reflective array antenna (not shown) was also fabricated to achieve a beam collimation in 45° relative to the broadside direction.

Each prototype was implemented on three Rogers RO4003C substrates. First dielectric layer 102 had a thickness of 1.52 mm. Second dielectric layer 106 was formed of two layers each having a thickness of 0.81 mm that were bonded together by two layers of 0.1 mm-thick Rogers RO4450F prepregs. The top and bottom metallic layers of each 2-bit phase shift element 100 were connected with plated via holes with diameters of 0.46 mm. The static ON/OFF states of the switches 306, 307, 308, 308 that configured the operating state of each 2-bit phase shift element 100 were implemented by the presence/absence of copper traces with widths of 0.3 mm on the bottom metallic layer. Conducting layer 107 of both fabricated reflective array antenna were identical while the metallic patterns on bottom surface 400 were different according to the switch configurations for realizing beam collimation at 0° and 45° relative to the broadside direction.

Figure 10:
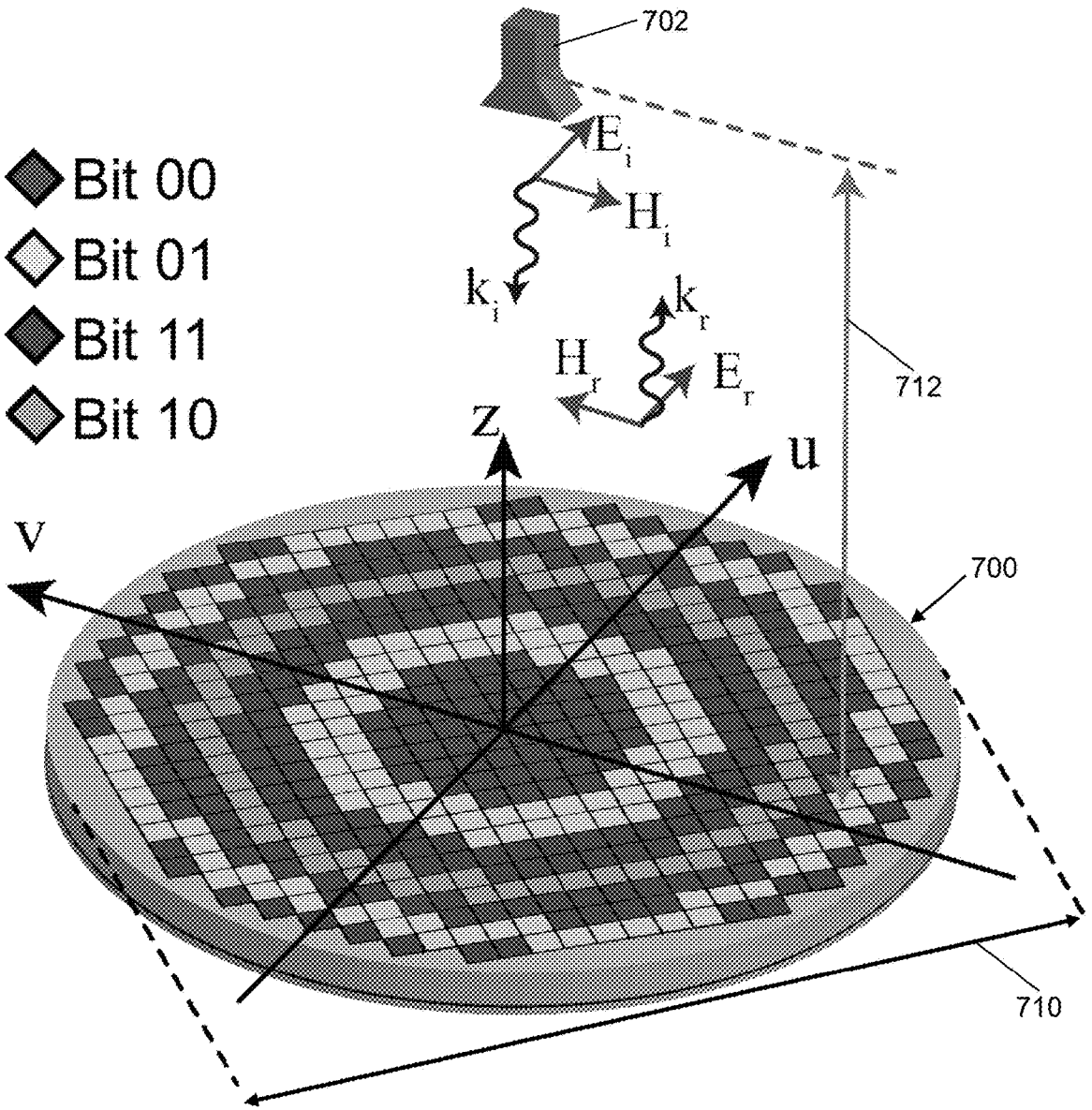
FIG. 10 depicts a side view of the transceiver system of FIG. 7 that includes the 2-bit phase shift element of FIG. 1 and that shows incident and reflective electric and magnetic field planes in accordance with an illustrative embodiment.

Referring to FIG. 10, a top perspective view of the distribution pattern of the switch position of fabricated reflective array antenna 900 is shown to illustrate a bit configuration (reflection mode) of each 2-bit phase shift element across a face of fabricated reflective array antenna 900 having an aperture length 710 of 30 centimeters (cm) to achieve the beam collimation in the broadside direction. A first incident wave vector $k_i$ points in a direction of incident wave propagation from feed antenna 702 positioned at a center of fabricated reflective array antenna 900 with focal distance 712 of 254 mm. A first reflected wave vector $k_r$ points in a direction of reflected wave propagation. Feed antenna 702 was a horn antenna with aperture dimensions of 4×4 $cm^2$.

The horn antenna was oriented so that the polarization of the incident wave was along the u-axis, or parallel to a diagonal line of the square shaped unit cells in fabricated reflective array antenna 900. The horn antenna was simulated and the amplitude and phase distribution of the radiated electromagnetic field in the plane of the intended position of the reflective array was extracted. The phase of the incident electric field at the center of each unit cell $\Phi_{inc}(x_i,y_i)$ and the desired outgoing phase $\Phi_d(x_b,y_i)$ were used to calculate the reflection phase shift that the unit cell needed to provide $\Phi_{ref}(x_i,y_i)=\Phi_d(x_i,y_i)-\Phi_{inc}(x_i,y_i)$.

The desired outgoing phase $\Phi_d(x_i,y_i)$ can be calculated from the direction of the main beam (($\theta_0=\alpha$ (azimuth) and $\phi_0=\beta$ (elevation)) in a spherical coordinate system) and the coordinate ($x_i$, $y_i$) of center 134 of 2-bit phase shift element 100 using $$\Phi_d(x_i, y_i) = \sqrt{x_i^2 + y_i^2}\ \sin(\alpha)\cos\left(\tan^{-1}\left(\frac{y_i}{x_i}\right) - \beta\right).$$

Subsequently, the necessary reflection phase shifts of the unit cells, wrapped into the range from −180° to 180°, are quantized into four levels and the operating mode of the unit cells are determined according to the following expression:

$$\text{Mode} = \begin{cases} 1, & \text{if } -45° \le \Phi_{ref}(x_i, y_i) < 45° \\ 2, & \text{if } 135° \le \Phi_{ref}(x_i, y_i) \text{ or } \Phi_{ref}(x_i, y_i) < -135° \\ 3, & \text{if } 45° \le \Phi_{ref}(x_i, y_i) < 135° \\ 4, & \text{if } -135° \le \Phi_{ref}(x_i, y_i) < -45° \end{cases}.$$

Using this method, distribution patterns for the switch positions of the 2-bit phase shift elements on the aperture of reflective array antenna 700 to generate a beam steered to scan angles at 0°, 15°, 30°, 45°, 60° relative to a boresight axis are shown in FIGS. 11A to 11E, respectively, in accordance with an illustrative embodiment, where "bit 00" indicates the first switch positions (first mode) for 2-bit phase shift element 100, "bit 11" indicates the second switch positions (second mode) for 2-bit phase shift element 100, "bit 01" indicates the third switch positions (third mode) for 2-bit phase shift element 100, and "bit 10" indicates the fourth switch positions (fourth mode) for 2-bit phase shift element 100, where each pixel represents a distinct 2-bit phase shift element 100.

Figure 11A:
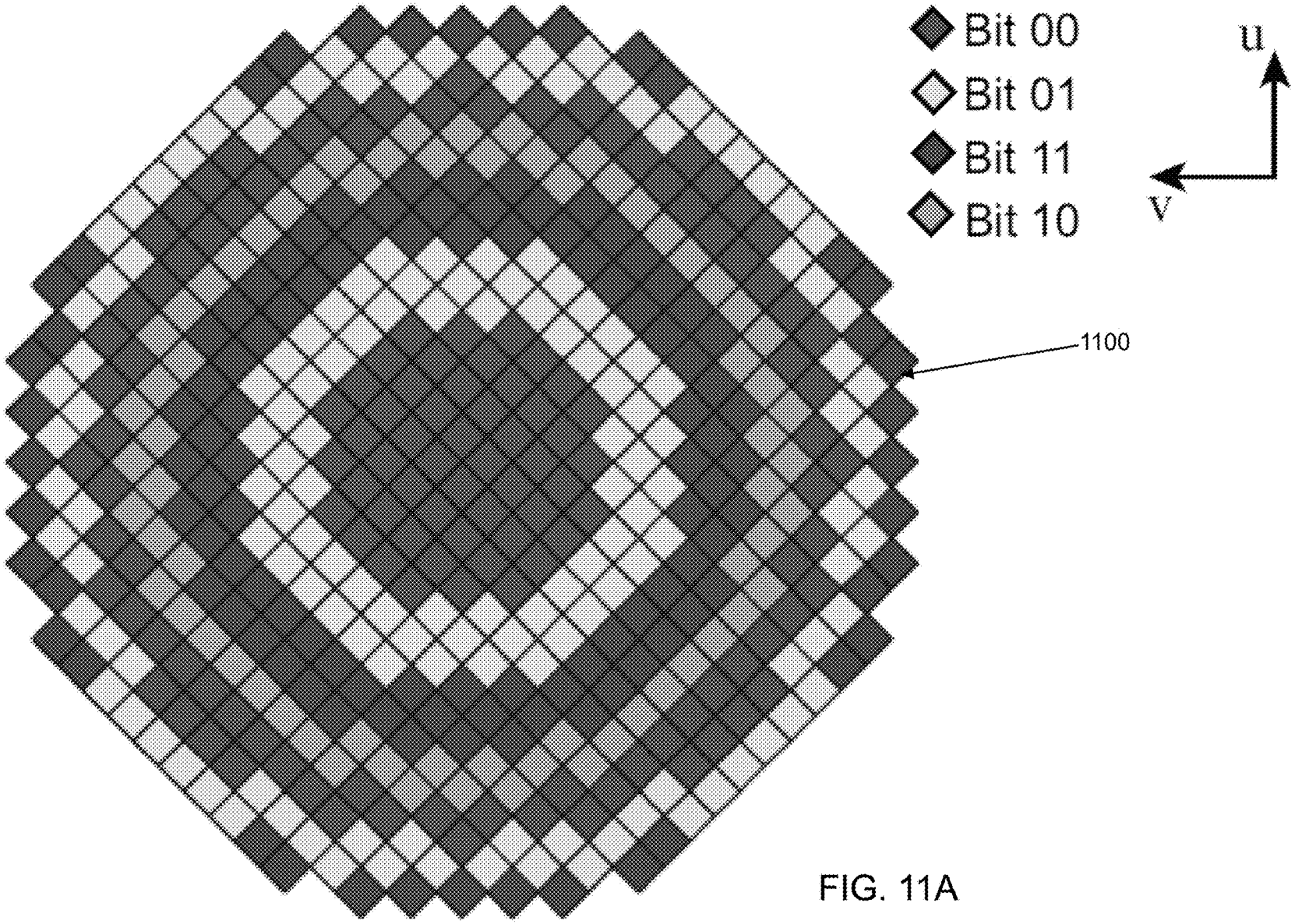
FIGS. 11A to 11E depict patterns of a distribution of the switch positions of the 2-bit phase shift elements on the aperture of the reflective array antenna to generate a beam steered to 0°, 15°, 30°, 45°, 60°, respectively, in accordance with an illustrative embodiment, where "bit 00" indicates first switch positions for the first mode, "bit 01" indicates third switch positions for the third mode, "bit 11" indicates second switch positions for the second mode, and "bit 10" indicates fourth switch positions for the fourth mode.
Figure 11B:
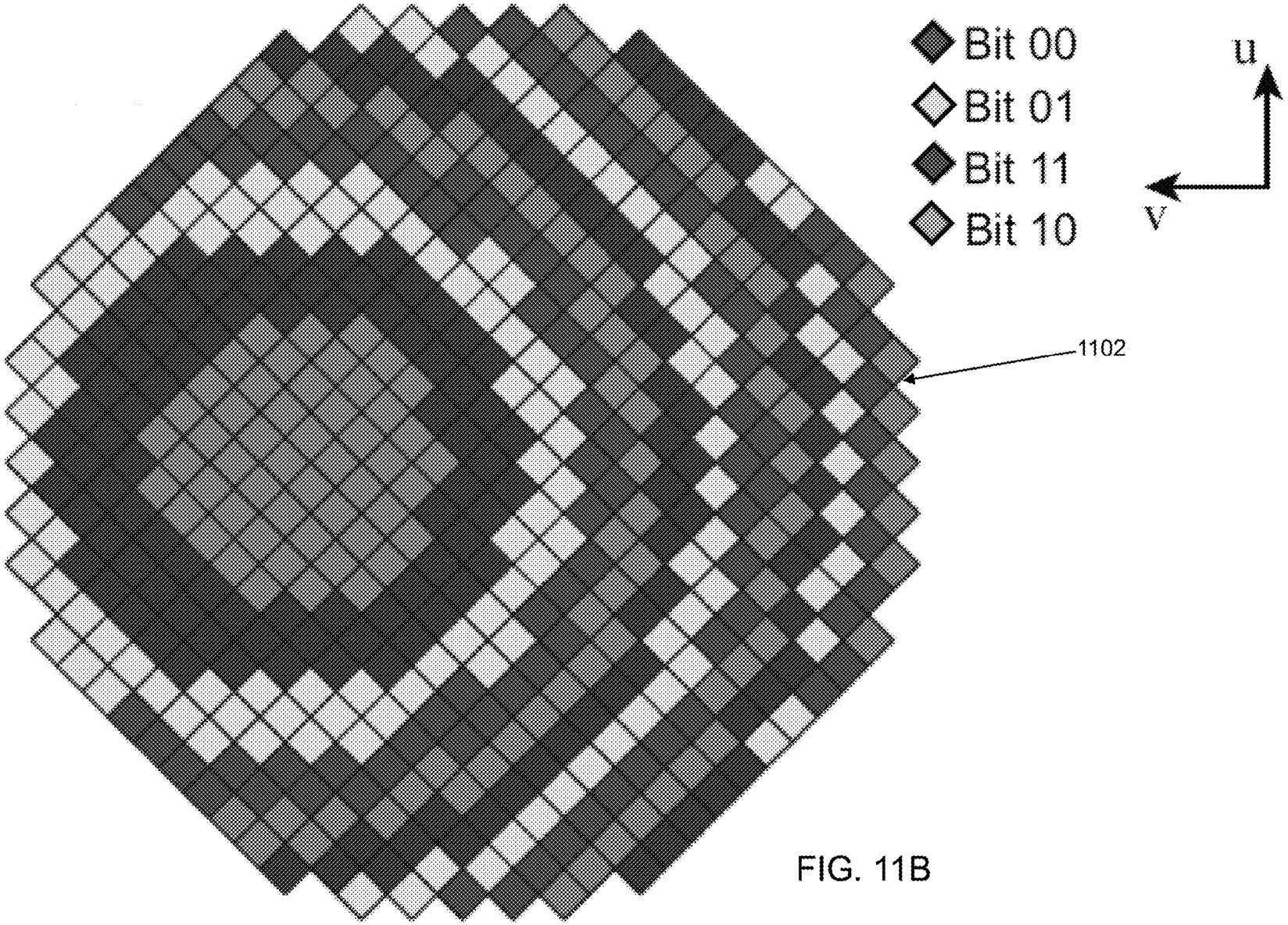
Figure 11C:
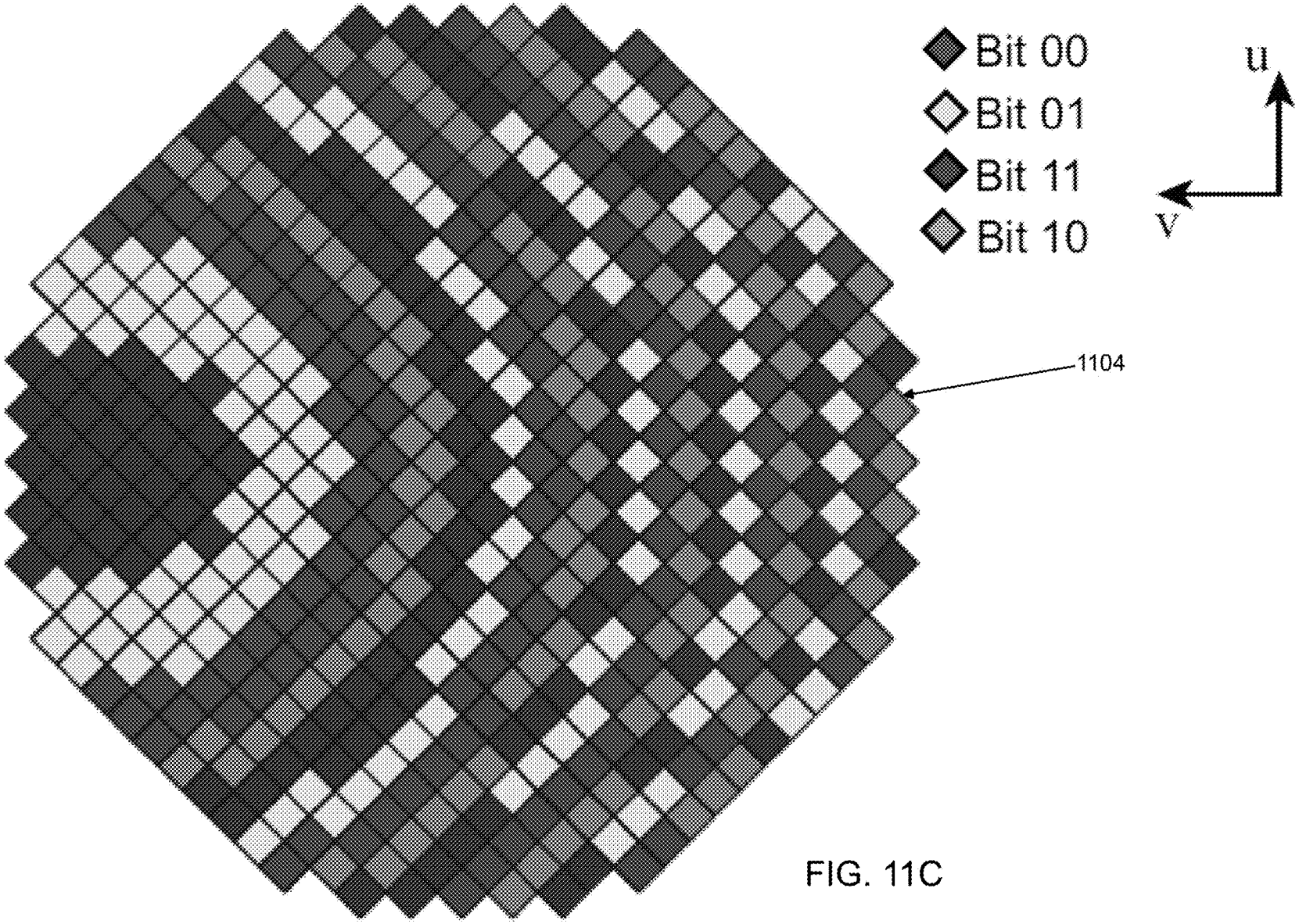
Figure 11D:
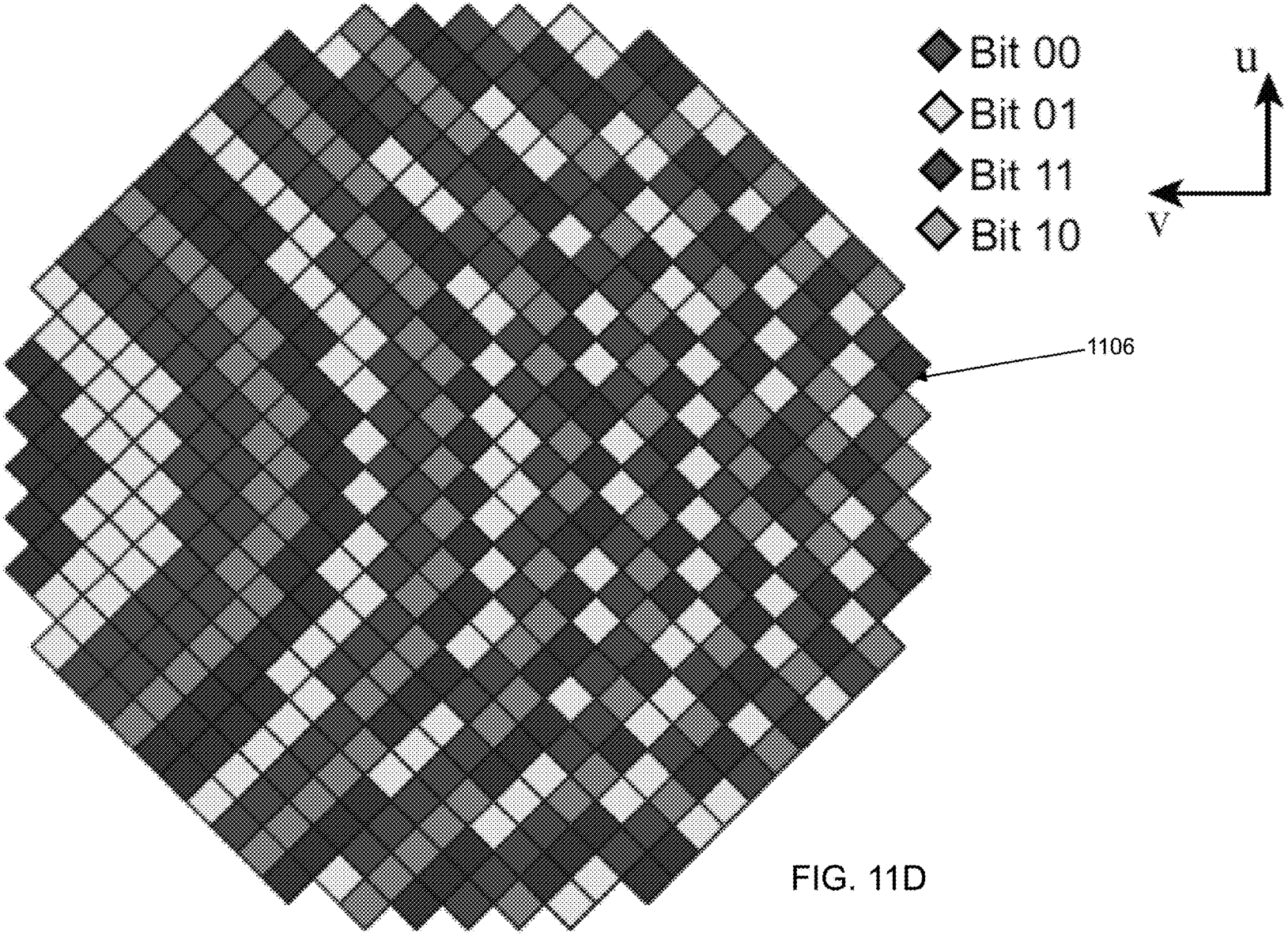
Figure 11E:
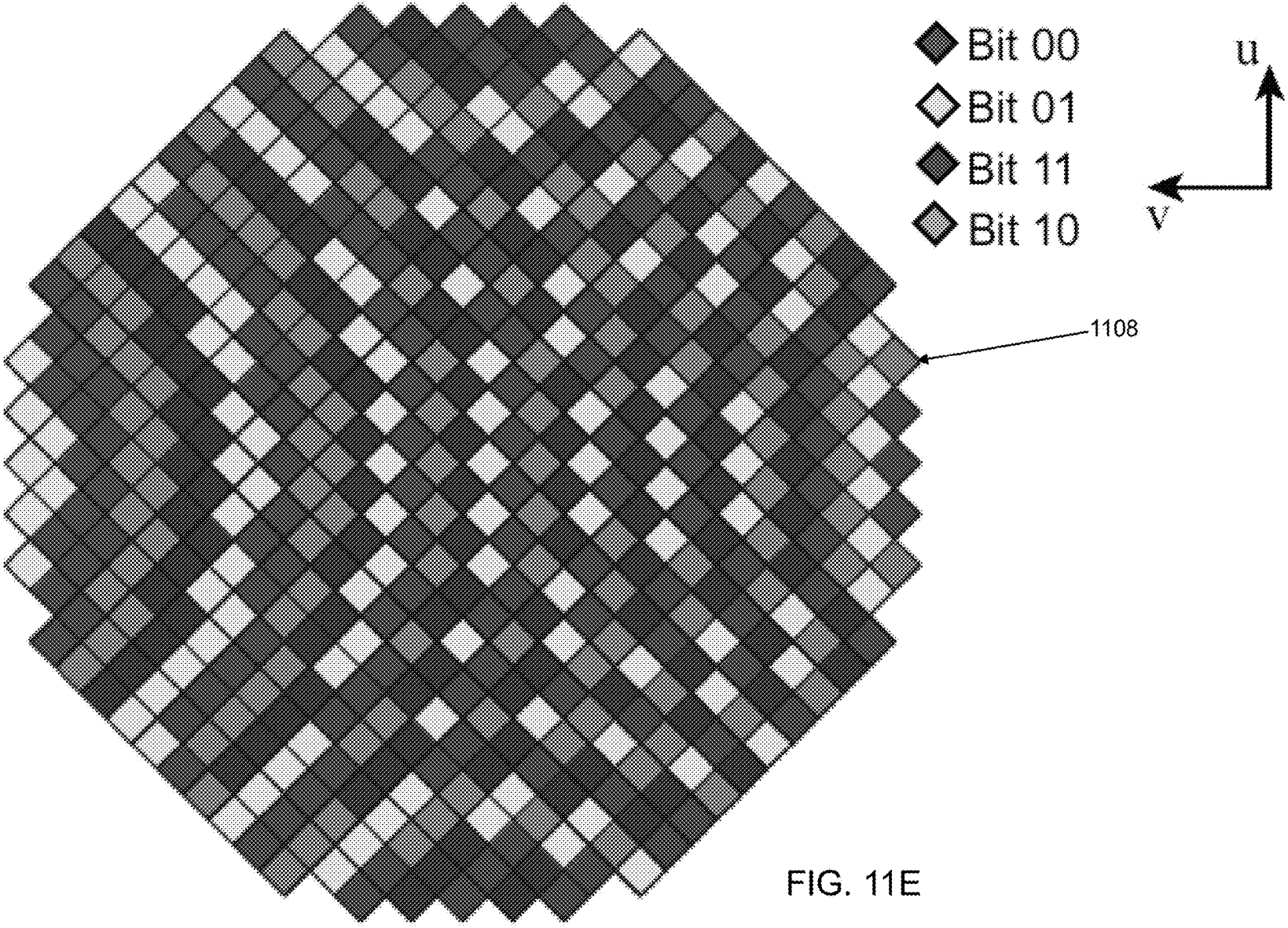

Referring to FIG. 11A, a top view of a 0° distribution pattern 1100 of the switch position of reflective array antenna 704 is shown to illustrate a bit configuration (reflection mode) of each 2-bit phase shift element across the face of reflective array antenna 704 to achieve the beam collimation in the broadside direction at 10 GHz. Reflective array antenna 900 was fabricated to have 0° distribution pattern 1100. Referring to FIG. 11B, a top view of a 15° distribution pattern 1102 of the switch position of reflective array antenna 704 is shown to illustrate a bit configuration (reflection mode) of each 2-bit phase shift element across the face of reflective array antenna 704 to achieve beam collimation 15° off of the broadside direction at 10 GHz. Referring to FIG. 11C, a top view of a 30° distribution pattern 1104 of the switch position of reflective array antenna 704 is shown to illustrate a bit configuration (reflection mode) of each 2-bit phase shift element across the face of reflective array antenna 704 to achieve beam collimation 30° off of the broadside direction at 10 GHz. Referring to FIG. 11D, a top view of a 45° distribution pattern 1106 of the switch position of reflective array antenna 704 is shown to illustrate a bit configuration (reflection mode) of each 2-bit phase shift element across the face of reflective array antenna 704 to achieve beam collimation 45° off of the broadside direction at 10 GHz. The second reflective array was fabricated to have 45° distribution pattern 1106. Referring to FIG. 11E, a top view of a 60° distribution pattern 1108 of the switch position of reflective array antenna 704 is shown to illustrate a bit configuration (reflection mode) of each 2-bit phase shift element across the face of reflective array antenna 704 to achieve beam collimation 60° off of the broadside direction at 10 GHz.

Full-wave simulations of the reflective array antenna 704 were performed for each of the distribution patterns configured for each scan angle 0°, 15°, 30°, 45°, 60° relative to the boresight axis in CST Microwave Studio to evaluate the beam steering performance within the operating frequency range of the unit cell from 9 GHz to 11 GHz.

Figure 12A:
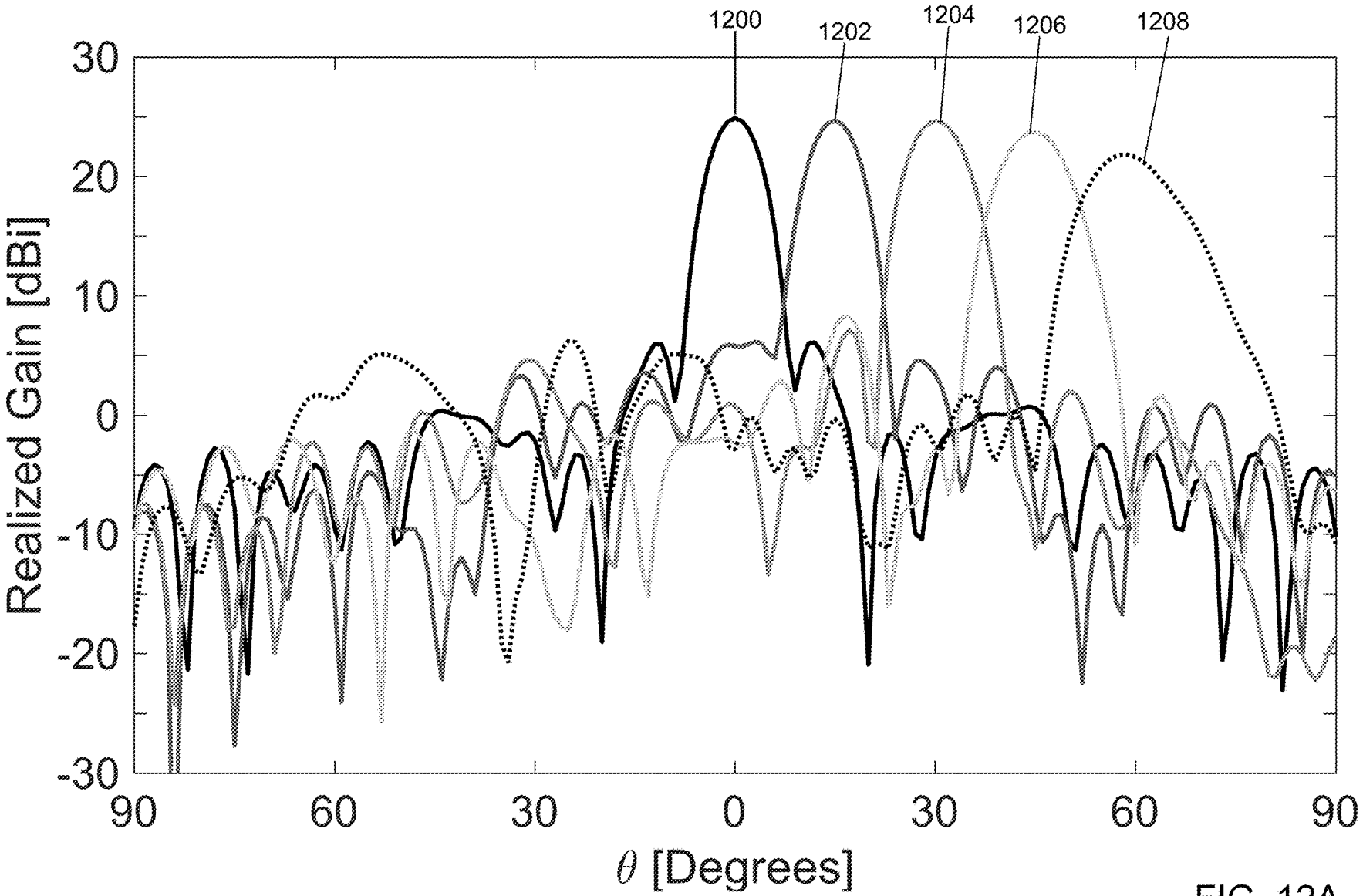
FIG. 12A depicts a simulated realized gain for the distribution patterns of FIGS. 11A to 11E as a function of zenith angle at 9.0 gigahertz (GHz) in accordance with an illustrative embodiment.

Referring to FIG. 12A, a simulated realized gain for the five different beam configurations as a function of zenith angle at 9 gigahertz (GHz) is shown in accordance with an illustrative embodiment. A first 9 GHz gain curve 1200 shows the simulated realized gain for the scan angle 0° at 9 GHz, a second 9 GHz gain curve 1202 shows the simulated realized gain for the scan angle 15° at 9 GHz, a third 9 GHz gain curve 1204 shows the simulated realized gain for the scan angle 30° at 9 GHz, a fourth 9 GHz gain curve 1206 shows the simulated realized gain for the scan angle 45° at 9 GHz, and a fifth 9 GHz gain curve 1208 shows the simulated realized gain for the scan angle 60° at 9 GHz.

Figure 12B:
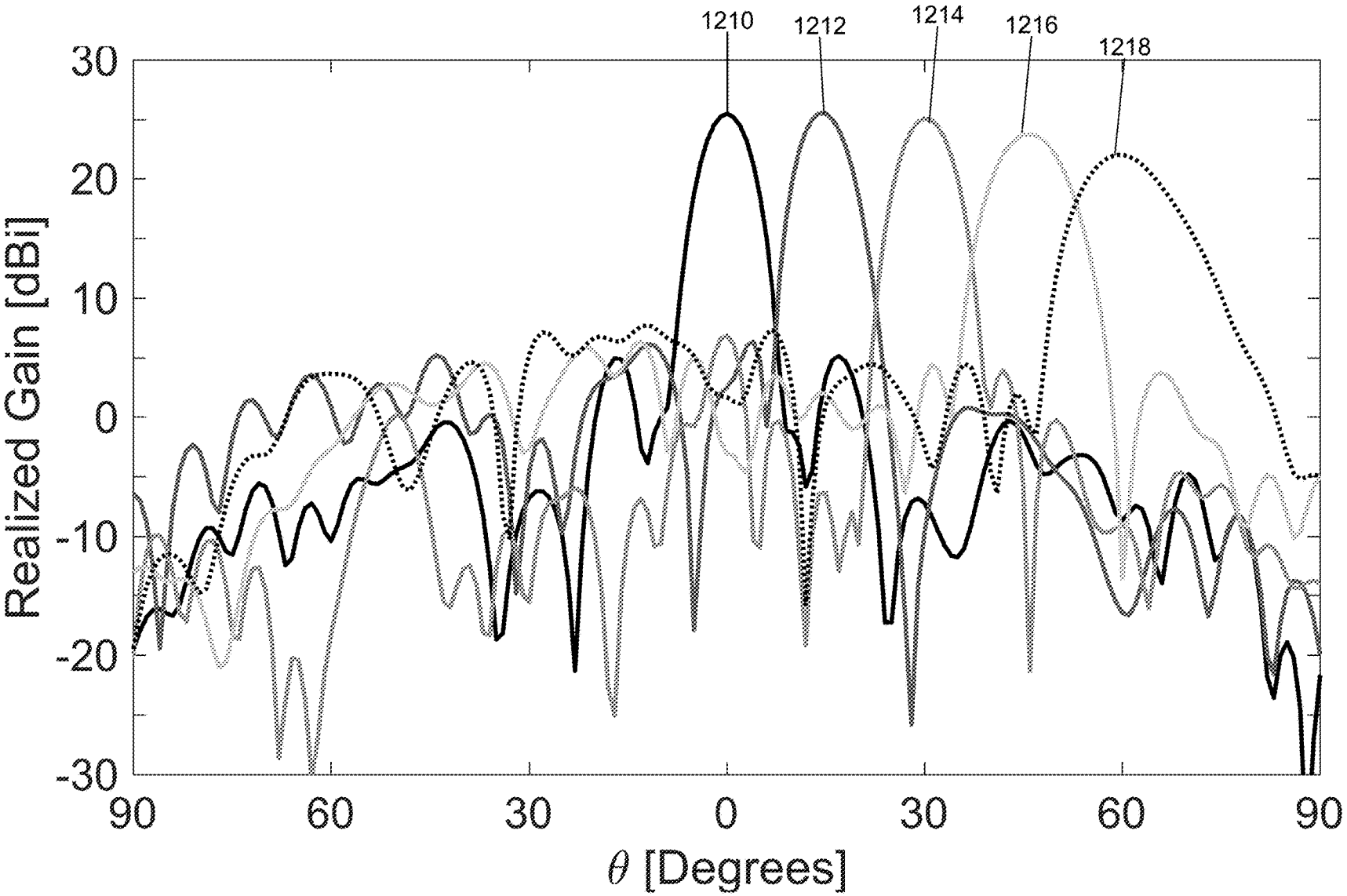
FIG. 12B depicts a simulated realized gain for the distribution patterns of FIGS. 11A to 11E as a function of zenith angle at 9.5 GHz in accordance with an illustrative embodiment.

Referring to FIG. 12B, a simulated realized gain for the five different beam configurations as a function of zenith angle at 9.5 GHz is shown in accordance with an illustrative embodiment. A first 9.5 GHz gain curve 1210 shows the simulated realized gain for the scan angle 0° at 9.5 GHz, a second 9.5 GHz gain curve 1212 shows the simulated realized gain for the scan angle 15° at 9.5 GHz, a third 9.5 GHz gain curve 1214 shows the simulated realized gain for the scan angle 30° at 9.5 GHz, a fourth 9.5 GHz gain curve 1216 shows the simulated realized gain for the scan angle 45° at 9.5 GHz, and a fifth 9.5 GHz gain curve 1218 shows the simulated realized gain for the scan angle 60° at 9.5 GHz.

Figure 12C:
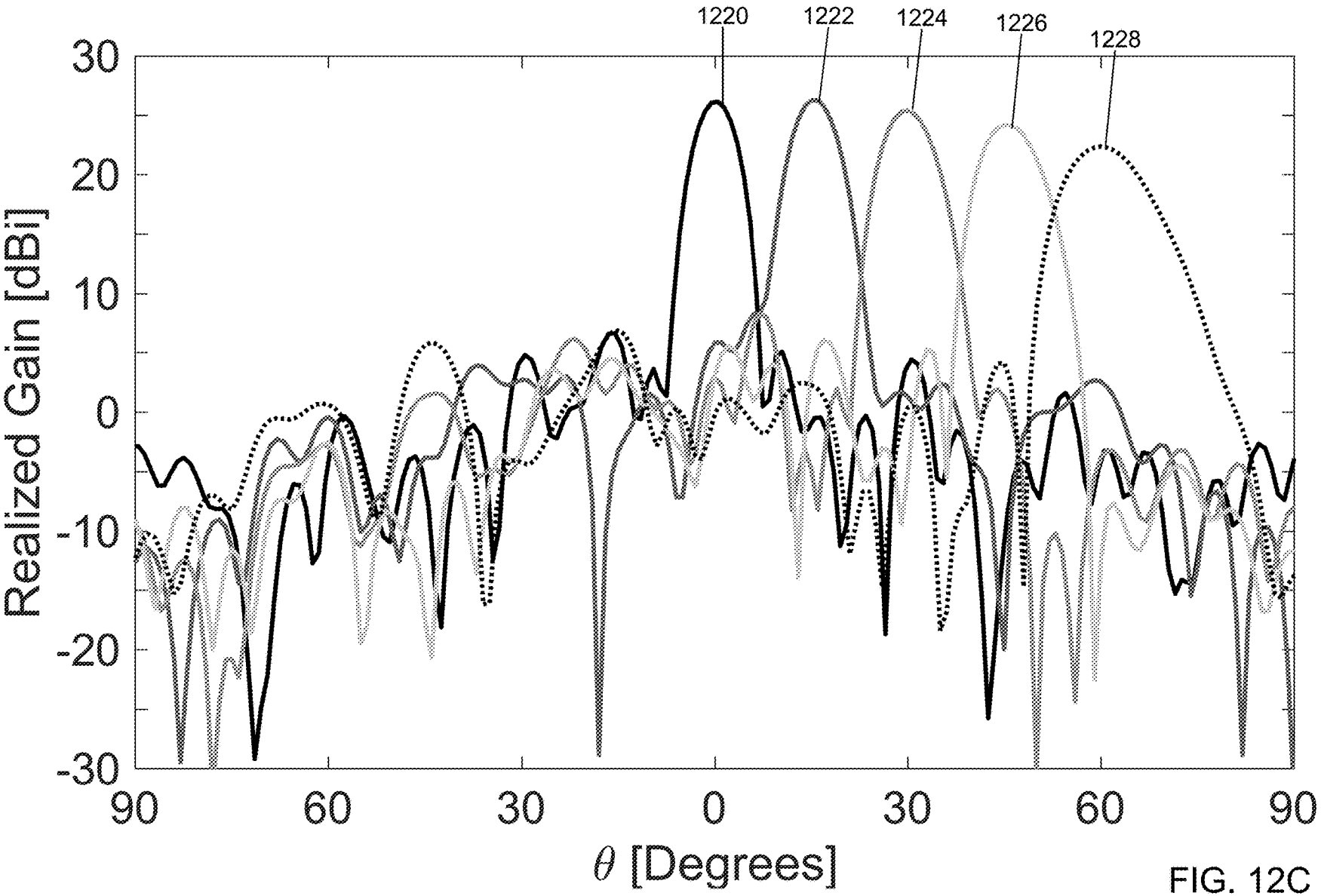
FIG. 12C depicts a simulated realized gain for the distribution patterns of FIGS. 11A to 11E as a function of zenith angle at 10.0 GHz in accordance with an illustrative embodiment.

Referring to FIG. 12C, a simulated realized gain for the five different beam configurations as a function of zenith angle at 10 GHz is shown in accordance with an illustrative embodiment. A first 10 GHz gain curve 1220 shows the simulated realized gain for the scan angle 0° at 10 GHz, a second 10 GHz gain curve 1222 shows the simulated realized gain for the scan angle 15° at 10 GHz, a third 10 GHz gain curve 1224 shows the simulated realized gain for the scan angle 30° at 10 GHz, a fourth 10 GHz gain curve 1226 shows the simulated realized gain for the scan angle 45° at 10 GHz, and a fifth 10 GHz gain curve 1228 shows the simulated realized gain for the scan angle 60° at 10 GHz.

Figure 12D:
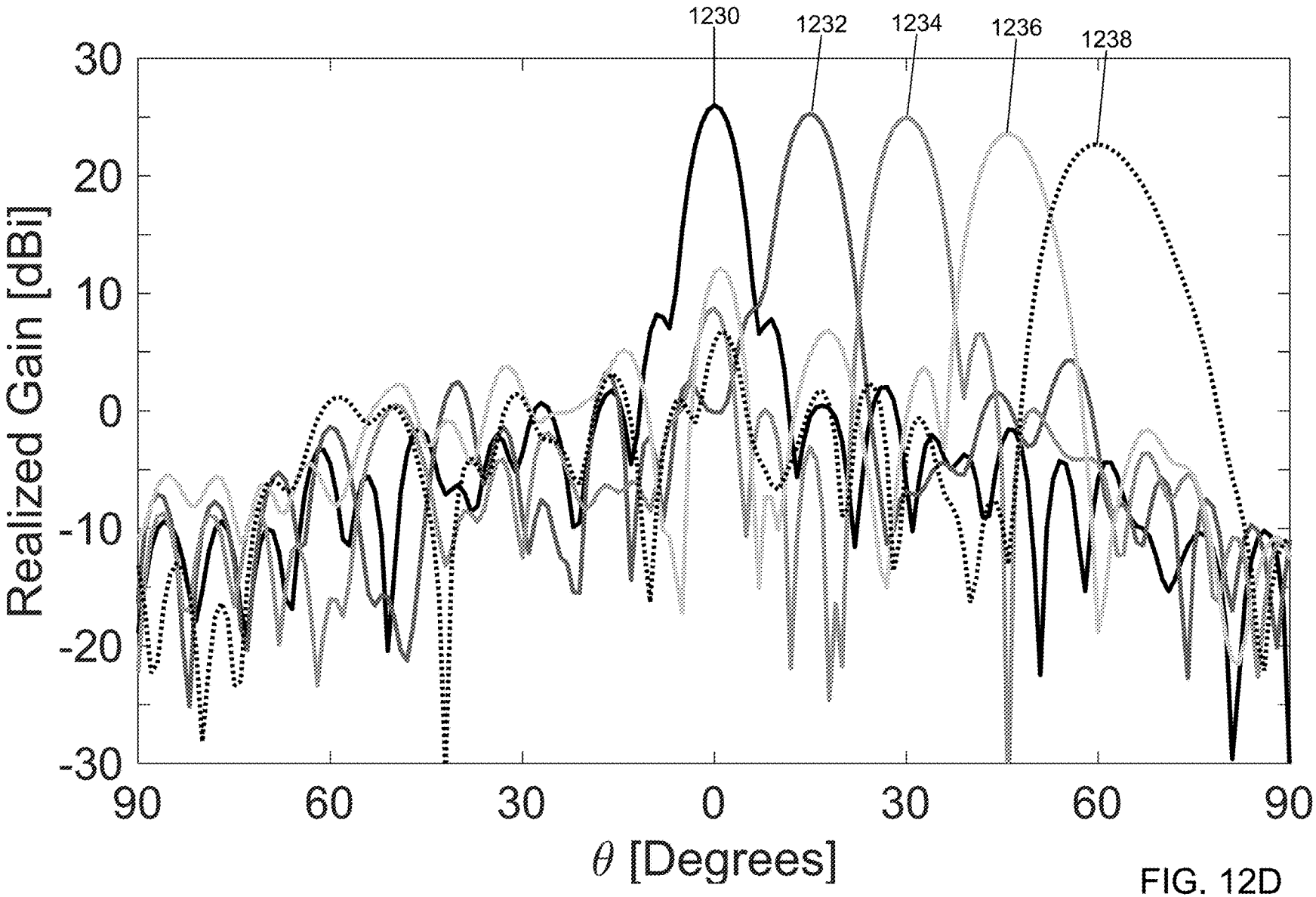
FIG. 12D depicts a simulated realized gain for the distribution patterns of FIGS. 11A to 11E as a function of zenith angle at 10.5 GHz in accordance with an illustrative embodiment.

Referring to FIG. 12D, a simulated realized gain for the five different beam configurations as a function of zenith angle at 10.5 GHz is shown in accordance with an illustrative embodiment. A first 10.5 GHz gain curve 1230 shows the simulated realized gain for the scan angle 0° at 10.5 GHz, a second 10.5 GHz gain curve 1232 shows the simulated realized gain for the scan angle 15° at 10.5 GHz, a third 10.5 GHz gain curve 1234 shows the simulated realized gain for the scan angle 30° at 10.5 GHz, a fourth 10.5 GHz gain curve 1236 shows the simulated realized gain for the scan angle 45° at 10.5 GHz, and a fifth 10.5 GHz gain curve 1238 shows the simulated realized gain for the scan angle 60° at 10.5 GHz.

Figure 12E:
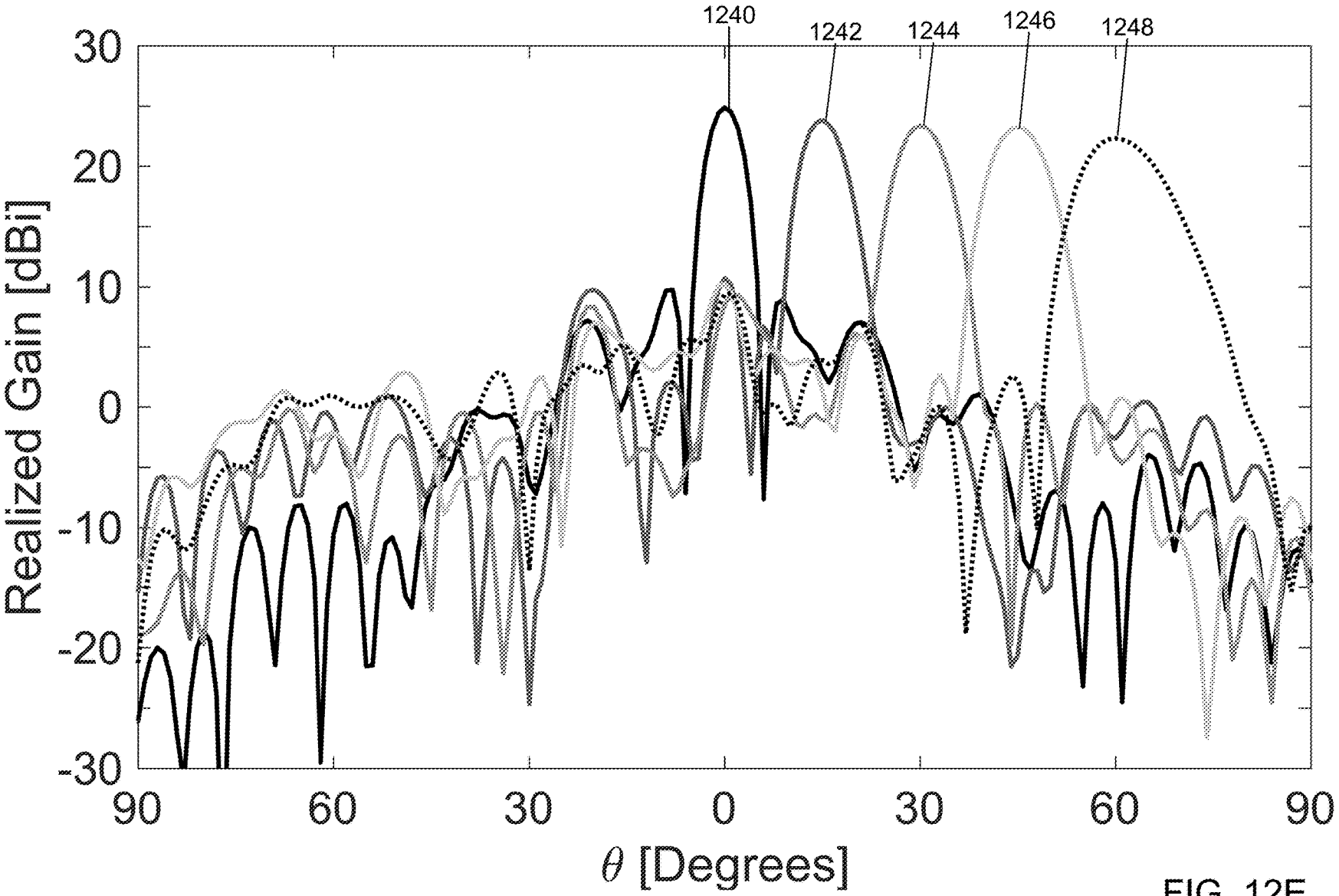
FIG. 12E depicts a simulated realized gain for the distribution patterns of FIGS. 11A to 11E as a function of zenith angle at 11 GHz in accordance with an illustrative embodiment.

Referring to FIG. 12E, a simulated realized gain for the five different beam configurations as a function of zenith angle at 11 GHz is shown in accordance with an illustrative embodiment. A first 11 GHz gain curve 1240 shows the simulated realized gain for the scan angle 0° at 11 GHz, a second 11 GHz gain curve 1242 shows the simulated realized gain for the scan angle 15° at 11 GHz, a third 11 GHz gain curve 1244 shows the simulated realized gain for the scan angle 30° at 11 GHz, a fourth 11 GHz gain curve 1246 shows the simulated realized gain for the scan angle 45° at 11 GHz, and a fifth 11 GHz gain curve 1248 shows the simulated realized gain for the scan angle 60° at 11 GHz.

For the same scan angle, the beam shapes are consistent and the gain variation is within 1.3 dB across the different frequency points. At 10 GHz, the peak realized gain is 26.2 dBi for $\theta_0$=0°, 26.2 dBi for $\theta_0$=15°, 25.4 dBi for $\theta_0$=30°, 24.2 dBi for $\theta_0$=45°, and 22.4 dBi for $\theta_0$=60°. The scan loss for steering the beam from broadside to a scan angle of 45° is about 1.2 dB at 9.0 GHz, 1.7 dB at 9.5 GHz, 2 dB at 10 GHz, 2.4 dB at 10.5 GHz, and 1.7 dB at 11.0 GHz. For a scan angle up to 60°, the scan loss is about 2.8-3.8 dB within the 9-11 GHz frequency range. The maximum gain variation within the scan angle range of ±45° and over the entire operating frequency range is about 3 dB. Moreover, side lobe levels are less than −13.3 dB for all scan angles at all five frequency points.

A static 2-bit and a static 1-bit reflective array antenna 704 were simulated to assess the improvement of using 2-bit phase shift element 100 over a 1-bit phase quantization. Both simulated reflective array antennas had the same aperture dimensions and were fed by the same antenna with the same focal distance. The 1-bit reflective array antenna 704 was populated by 1-bit phase shifters having the two polarization rotating modes similar to Modes 1 and 2 of 2-bit phase shift element 100. The phase shifters on both arrays were configured following corresponding 1-bit and 2-bit Fresnel patterns for beam collimation at the broadside direction at 10 GHz.

Figure 13:
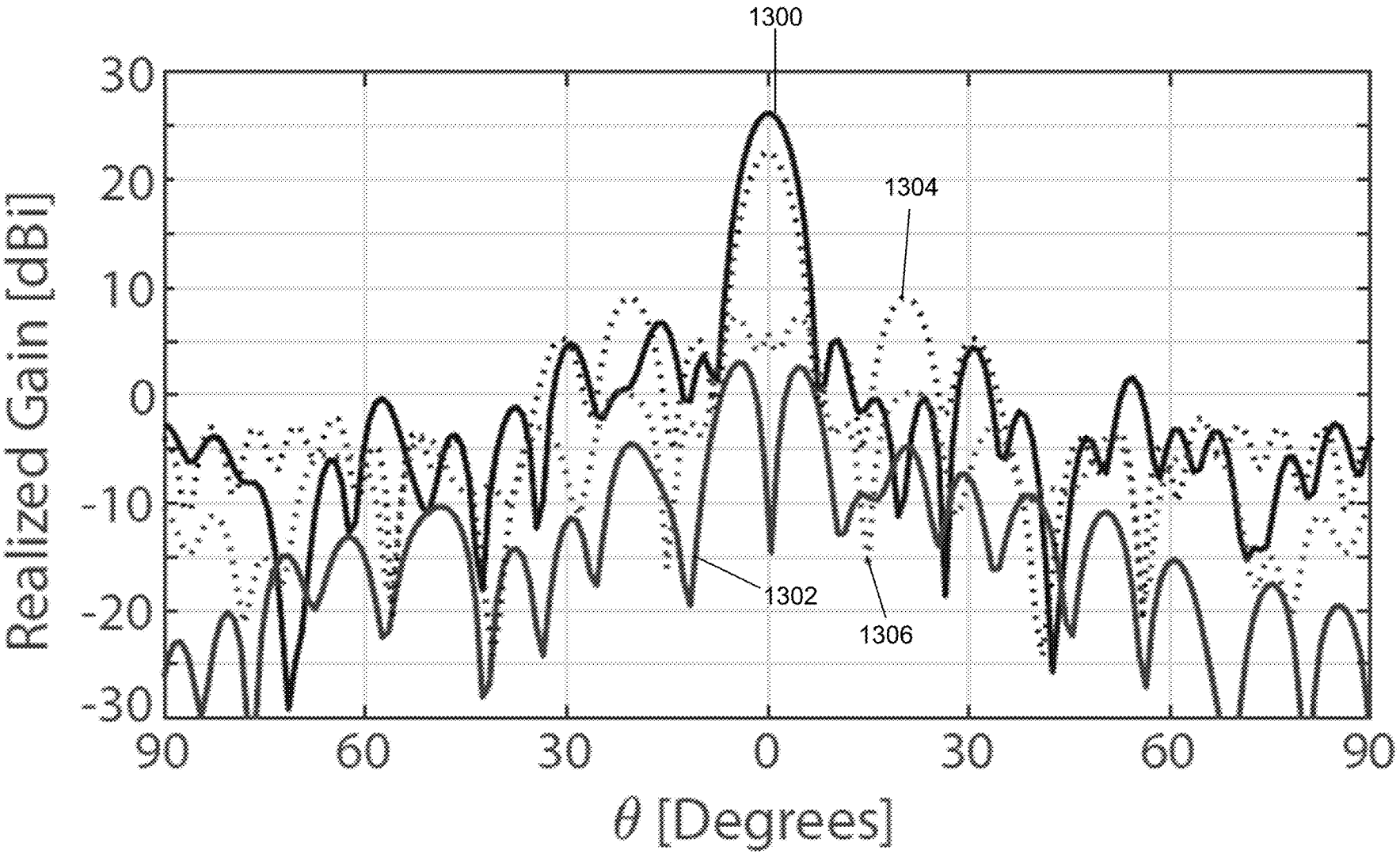
FIG. 13 depicts a comparison between a simulated radiation pattern computed for 2-bit phase shift elements on the aperture of the reflective array antenna and for 1-bit phase shift elements on the aperture of the reflective array as a function of angle at 10 GHz in accordance with an illustrative embodiment.

Referring to FIG. 13, a comparison between a simulated radiation pattern computed for the 2-bit reflective array antenna 704 and for the 1-bit reflective array antenna 704 as a function of zenith angle at 10 GHz is shown in accordance with an illustrative embodiment. The 2-bit reflective array antenna 704 as shown by a first curve 1300 provides a maximum realized gain of 26.2 dBi which is 3.5 dB higher than a maximum realized gain of 22.7 dBi provided by the 1-bit reflective array antenna 704 as shown by a second curve 1304. Additionally, the 2-bit reflective array antenna 704 exhibits a 7-dB lower side lobe level compared to the 1-bit reflective array antenna 704. Moreover, the maximum, normalized cross-polarization level of the 2-bit reflective array antenna 704 as shown by a third curve 1302 is about 8 dB lower than that of the 1-bit reflective array antenna 704 as shown by a fourth curve 1306. Of course, the improvement in the peak gains, side lobe levels, and polarization purity of using the 2-bit phase shifters comes at the expense of reduced bandwidths.

Figure 14:
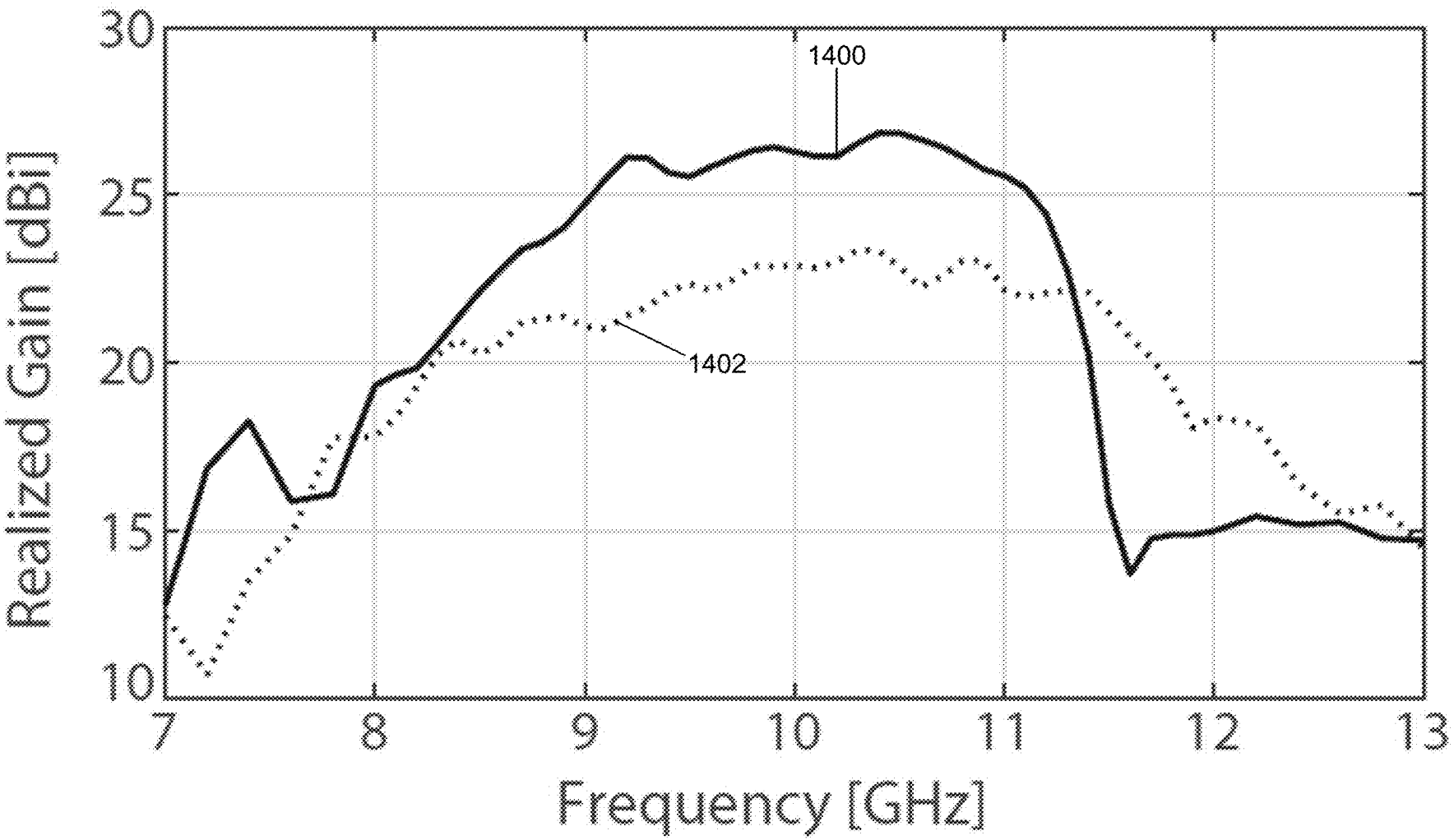
FIG. 14 depicts a comparison between a simulated peak gain computed for 2-bit phase shift elements on the aperture of the reflective array antenna and for 1-bit phase shift elements on the aperture of the reflective array as a function of frequency in accordance with an illustrative embodiment.

Referring to FIG. 14, a comparison between a simulated peak gain computed for the 2-bit reflective array antenna 704 as shown by a fifth curve 1400 and for the 1-bit reflective array antenna 704 as shown by a sixth curve 1402 as a function of frequency is shown in accordance with an illustrative embodiment. The 3-dB gain bandwidths are from 8.9 GHz to 11.2 GHz (23%) for the 2-bit reflective array antenna 704 and from 8.6 GHz to 11.6 GHz (30%) for the 1-bit reflective array antenna 704. Therefore, for applications that do not require bandwidths of larger than 23%, 2-bit phase shift element 100 can be used to provide significant improvement in beam collimation performance of reflective array antennas compared to 1-bit phase shifters, Radiation patterns were characterized for both of the fabricated antennas using a near-field spherical measurement system placed inside an anechoic chamber. During the measurements, a styrofoam fixture was used to position feed antenna 702 at the desired focal distance and to align its E-plane properly with respect to the reflective array antennas fabricated.

Figure 15A:
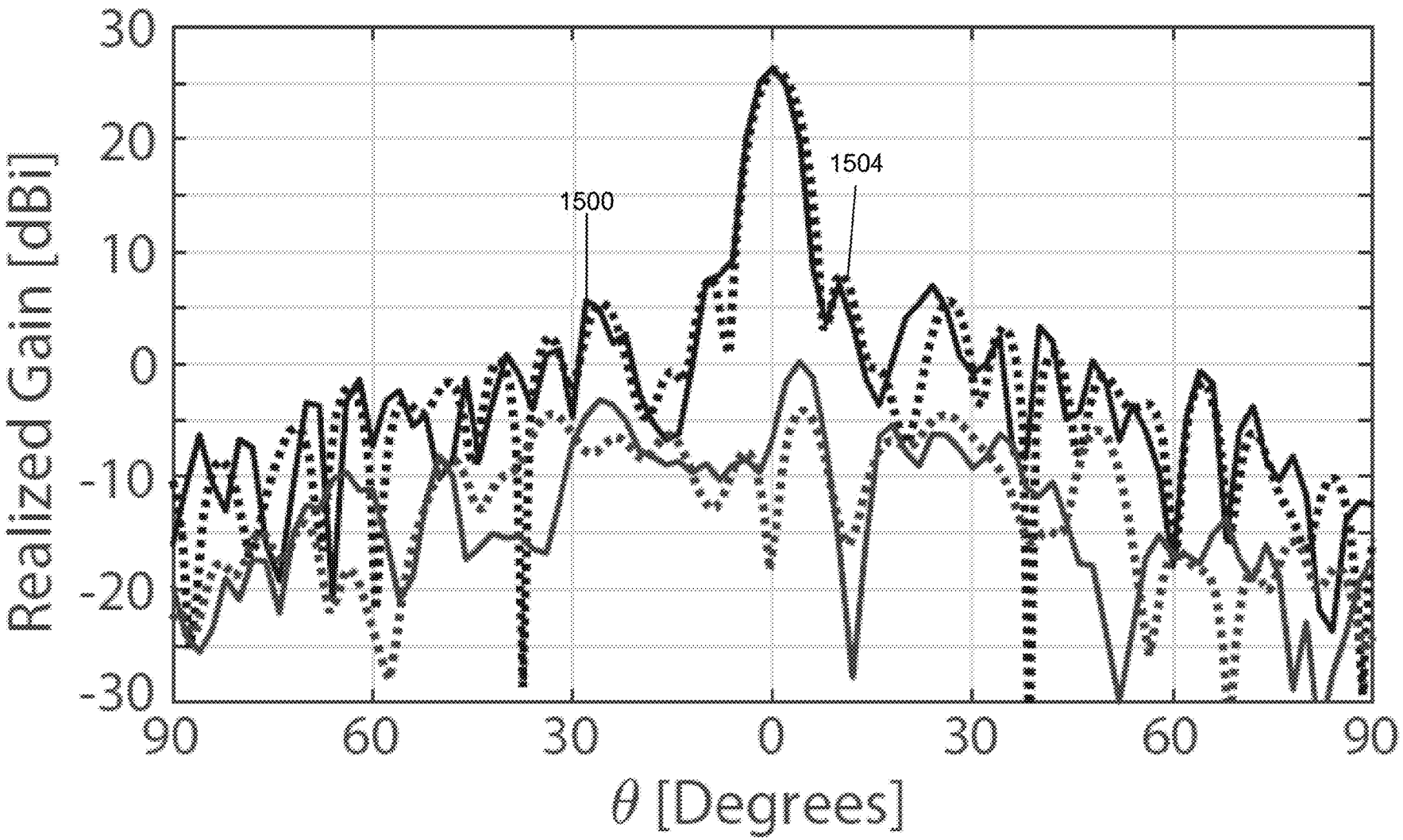
FIG. 15A depicts a comparison between the simulated and the measured radiation patterns as a function of zenith angle at 10 GHz in the E-plane for a beam centered at 0° in accordance with an illustrative embodiment.
Figure 15B:
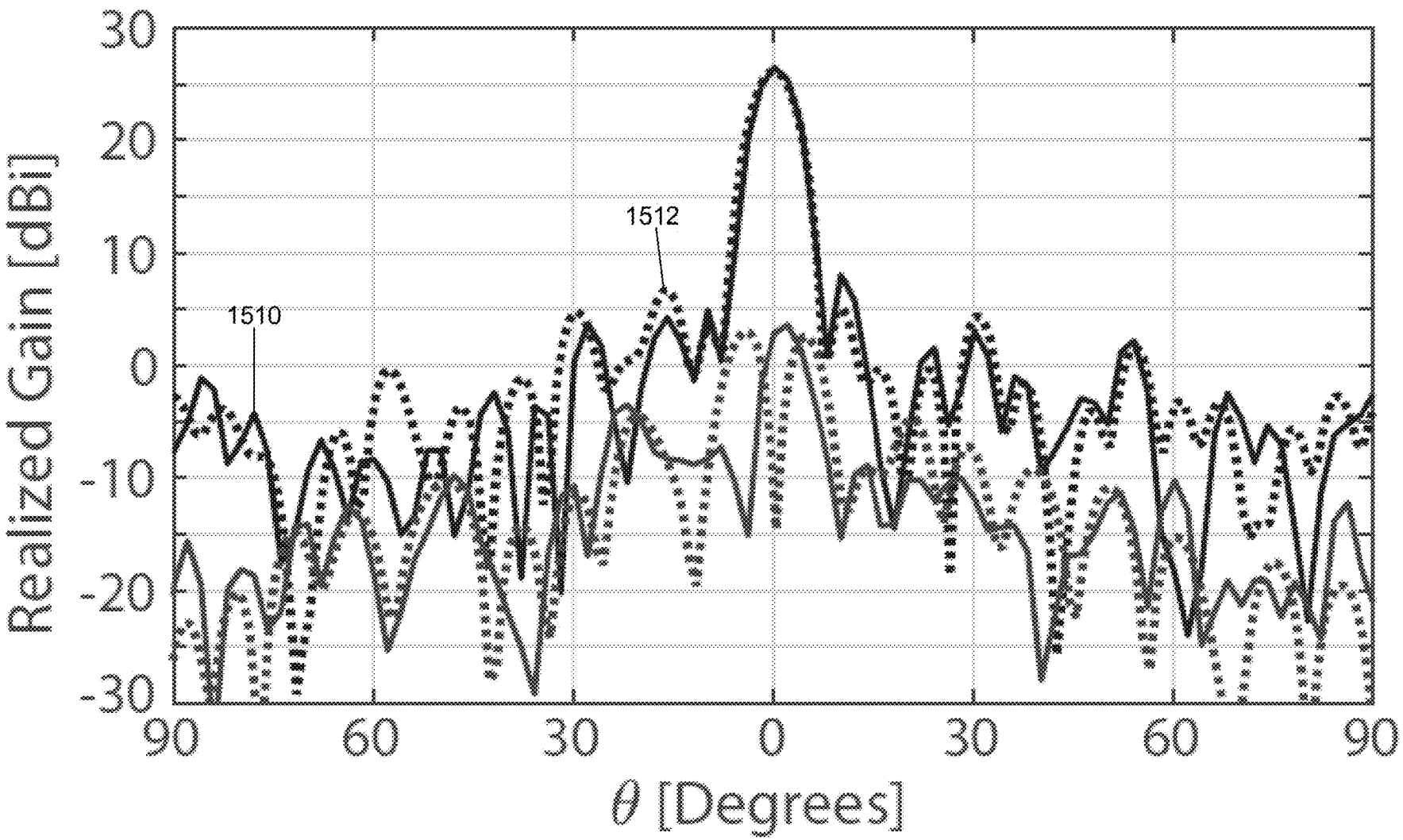
FIG. 15B depicts a comparison between the simulated and the measured radiation patterns as a function of zenith angle at 10 GHz in the H-plane for a beam centered at 0° in accordance with an illustrative embodiment.

Referring to FIG. 15A, a comparison between the simulated and the measured radiation patterns as a function of angle at 10 GHz in the E-plane for a main beam centered at 0° is shown in accordance with an illustrative embodiment. Referring to FIG. 15B, a comparison between the simulated and the measured radiation patterns as a function of angle at 10 GHz in the H-plane for a main beam centered at 0° is shown in accordance with an illustrative embodiment. The measured radiation patterns were generated using reflective array antenna 900. The measured realized gain at the broadside direction of reflective array antenna 900 was 26.5 dBi as shown by a seventh curve 1500 for the E-plane and as shown by an eighth curve 1510 for the H-plane, which agrees well with the predicted value of 26.2 dBi in the full-wave simulations as shown by a ninth curve 1502 for the E-plane and as shown by a tenth curve 1512 for the H-plane. Reflective array antenna 900 provided side lobe levels lower than −18.5 dB in both cut planes while the simulated side lobe levels were less than −19.5 dB in the E-plane and −18.1 dB in the H-plane. The measured cross-polarization levels, normalized to the maximum realized gain, were below −22.9 in the E-plane and −26.2 dB in the H-plane. These cross-polarization levels are slightly higher than the simulated values which were less than −23.2 dB and −30.3 dB in the E-plane and H-plane, respectively.

Figure 16:
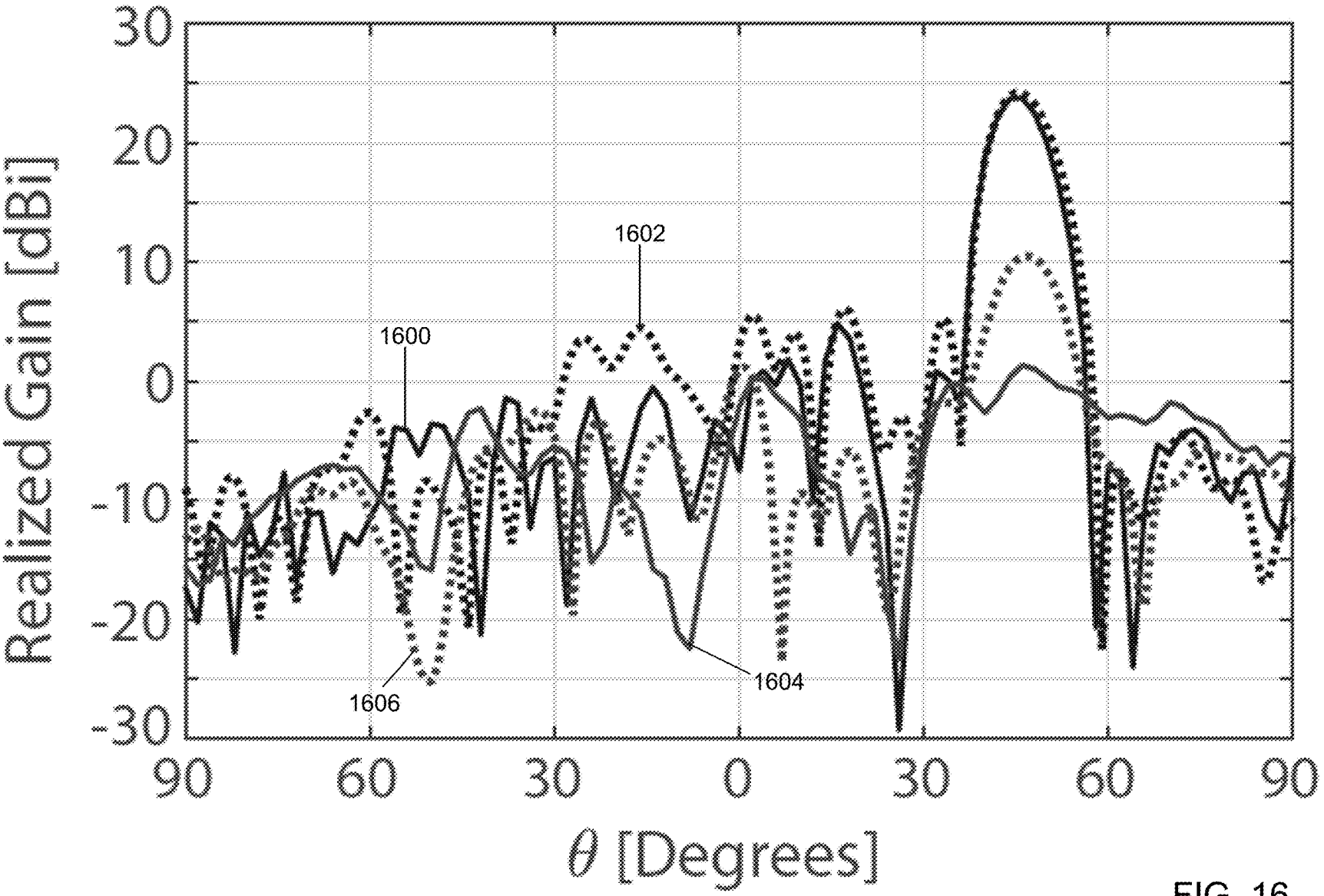
FIG. 16 depicts a comparison between the simulated and the measured radiation patterns as a function of zenith angle at 10 GHz in the H-plane for a beam centered at 45° in accordance with an illustrative embodiment.

Referring to FIG. 16, a comparison between the simulated and the measured radiation patterns as a function of angle at 10 GHz in the H-plane for a main beam steered to 45° relative to the boresight axis is shown in accordance with an illustrative embodiment. The measured radiation patterns were generated using the second reflective array antenna that was fabricated with 45° distribution pattern 1106 shown referring to FIG. 11D. The peak measured gain of the co-polarization pattern was 23.8 dBi at $\theta_0$=45° as shown by an eleventh curve 1600, which is about 0.4 dB smaller than the predicted value in the full-wave simulations as shown by a twelfth curve 1602. The measured side lobe levels of less than −18.9 dB was slightly lower than the simulated values of less than −18.1 dB. A more pronounced difference between the measurement and simulation results was observed in the cross-polarization levels in the direction of the main beam. Specifically, the second reflective array antenna provided a significantly higher polarization purity of 22.5 dB as shown by a thirteenth curve 1604 compared to the simulated value of 14.1 dB as shown by a fourteenth curve 1606. The discrepancies between the measurement and simulation results of the two prototypes can be partly attributed to fabrication tolerances, uncertainties in measurements, and the dielectric properties of the Rogers materials used for constructing the second reflective array antenna, as well as slight errors in positioning and aligning feed antenna 702 with respect to the second reflective array antenna. Other components of the measurement setup that were not taken into account in the full wave simulations such as the styrofoam fixture, a short section of coaxial-to-waveguide transition used for feed antenna 702, and a coaxial cable connecting feed antenna 702 to a test port of the measurement chamber also contributed to these discrepancies. Nevertheless, the measurement and simulation results show reasonable agreement in terms of key features such as directions of the main beam, peak gains, and side lobe levels for both fabricated reflective array antennas.

As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, etch, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or a thermoforming process as understood by a person of skill in the art. As a result, elements described herein as being mounted to each other need not be discrete structural elements. The elements may be mounted permanently, removably, or releasably unless specified otherwise.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computer to implement the disclosed embodiments.

Any directional references used herein, such as left-side, right-side, top, bottom, back, front, up, down, above, below, etc., are for illustration only based on the orientation in the drawings selected to describe the illustrative embodiments.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A phase shift element comprising:

a first dielectric layer including a top, first dielectric surface and a bottom, first dielectric surface, wherein the top, first dielectric surface is on an opposite side of the first dielectric layer relative to the bottom, first dielectric surface, wherein the first dielectric layer is formed of a first dielectric material;

a conductive layer including a top conductive surface and a bottom conductive surface, wherein the top conductive surface is on an opposite side of the conductive layer relative to the bottom conductive surface, wherein the bottom conductive surface is mounted to the top, first dielectric surface, wherein the conductive layer is formed of a first conductive material;

a second dielectric layer including a top, second dielectric surface and a bottom, second dielectric surface, wherein the top, second dielectric surface is on an opposite side of the second dielectric layer relative to the bottom, second dielectric surface, wherein the bottom, second dielectric surface is mounted to the top conductive surface, wherein the second dielectric layer is formed of a second dielectric material;

a conducting pattern layer including a plurality of conductors mounted to the top, second dielectric surface, wherein the conducting pattern layer is formed of a second conductive material, wherein each conductor of the plurality of conductors is orthogonal to two other conductors of the plurality of conductors;

a plurality of switches mounted to the bottom, first dielectric surface, wherein each switch of the plurality of switches is configured to be switchable between a conducting position and a non-conducting position; and a plurality of vertical interconnect accesses (vias), wherein each vertical interconnect access (via) of the plurality of vias is formed of a third conductive material that extends through the first dielectric layer, through a third dielectric material formed in and through the conductive layer, and through the second dielectric layer, wherein each via of the plurality of vias is connected to a single conductor of the plurality of conductors;

wherein the first conductive material is configured to reflect an electromagnetic wave incident on the conducting pattern layer and on the second dielectric layer, wherein, when a switch of the plurality of switches is in the conducting position, the switch electrically connects two conductors of the plurality of conductors to each other through their respective vias, wherein a plurality of different switch configurations of the plurality of switches provide a 2-bit phase quantization on the reflected electromagnetic wave relative to the electromagnetic wave incident on the conducting pattern layer when the electromagnetic wave is incident on the conducting pattern layer.

2. The phase shift element of claim 1, wherein at least one of the first conductive material, the second conductive material, and the third conductive material is a different conductive material.

3. The phase shift element of claim 1, wherein at least one of the first dielectric material, the second dielectric material, and the third dielectric material is a different dielectric material.

4. The phase shift element of claim 1, wherein the first dielectric layer is formed of a plurality of layers of different dielectric materials.

5. The phase shift element of claim 1, wherein the first dielectric material is air.

6. The phase shift element of claim 1, wherein a number of the plurality of conductors is four and a number of the vias is four.

7. The phase shift element of claim 6, wherein each switch of the plurality of switches is a single pole, single throw switch, and a number of the plurality of switches is four.

8. The phase shift element of claim 1, wherein a first switch of the plurality of switches is configured to electrically connect a first via to a second via, wherein a second switch of the plurality of switches is configured to electrically connect the second via to a third via, wherein a third switch of the plurality of switches is configured to the third via to a fourth via, and wherein a fourth switch of the plurality of switches is configured to electrically connect the fourth via to the first via.

9. The phase shift element of claim 8, wherein each conductor of the plurality of conductors has an arrow shape comprised of a first arrow tip arm, a second arrow tip arm, and a shaft.

10. The phase shift element of claim 9, wherein the first arrow tip arm is perpendicular to the second arrow tip arm.

11. The phase shift element of claim 9, wherein the shaft of each arrow shape is rotated by 90 degrees relative to an adjacent shaft.

12. The phase shift element of claim 9, wherein the shaft of each arrow shape is pointed outward from a center of the plurality of conductors.

13. The phase shift element of claim 9, wherein the shaft electrically connects the first arrow tip arm and the second arrow tip arm to a respective via of the plurality of vias.

14. The phase shift element of claim 13, wherein a first switch configuration includes the first switch electrically connecting the first via to the second via, the second switch electrically connecting the second via to the third via, the third switch in the non-conducting position, and the fourth switch in the non-conducting position.

15. The phase shift element of claim 14, wherein a second switch configuration includes the first switch electrically connecting the first via to the second via, the fourth switch electrically connecting the fourth via to the first via, the second switch in the non-conducting position, and the third switch in the non-conducting position.

16. The phase shift element of claim 15, wherein a third switch configuration includes the first switch electrically connecting the first via to the second via, the second switch electrically connecting the second via to the third via, the third switch electrically connecting the third via to the fourth via, and the fourth switch electrically connecting the fourth via to the first via.

17. The phase shift element of claim 16, wherein a fourth switch configuration includes the first switch, the second switch, the third switch, and the fourth switch in the non-conducting position.

18. The phase shift element of claim 1, wherein a first electrical path length of each conductor of the plurality of conductors in combination with the respective via is approximately a quarter of a wavelength $\lambda_0/4$, where $\lambda_0=c/f_0$, where c is a speed of light, and $f_0$ is a central operating frequency of the incident electromagnetic wave.

19. The phase shift element of claim 18, wherein a second electrical path length of each switch in the conducting position is less than $\lambda_0/5$.

20. A phased array antenna comprising:

a first dielectric layer including a top, first dielectric surface and a bottom, first dielectric surface, wherein the top, first dielectric surface is on an opposite side of the first dielectric layer relative to the bottom, first dielectric surface, wherein the first dielectric layer is formed of a first dielectric material;

a conductive layer including a top conductive surface and a bottom conductive surface, wherein the top conductive surface is on an opposite side of the conductive layer relative to the bottom conductive surface, wherein the bottom conductive surface is mounted to the top, first dielectric surface, wherein the conductive layer is formed of a first conductive material;

a second dielectric layer including a top, second dielectric surface and a bottom, second dielectric surface, wherein the top, second dielectric surface is on an opposite side of the second dielectric layer relative to the bottom, second dielectric surface, wherein the bottom, second dielectric surface is mounted to the top conductive surface, wherein the second dielectric layer is formed of a second dielectric material; and a plurality of phase shift elements distributed in a direction, wherein each phase shift element of the plurality of phase shift elements comprises a conducting pattern layer including a plurality of conductors mounted to the top, second dielectric surface, wherein the conducting pattern layer is formed of a second conductive material, wherein each conductor of the plurality of conductors is orthogonal to two other conductors of the plurality of conductors;

a plurality of switches mounted to the bottom, first dielectric surface, wherein each switch of the plurality of switches is configured to be switchable between a conducting position and a non-conducting position; and a plurality of vertical interconnect accesses (vias), wherein each vertical interconnect access (via) of the plurality of vias is formed of a third conductive material that extends through the first dielectric layer, through a third dielectric material formed in and through the conductive layer, and through the second dielectric layer, wherein each via of the plurality of vias is connected to a single conductor of the plurality of conductors;

wherein the first conductive material is configured to reflect an electromagnetic wave incident on the conducting pattern layer and on the second dielectric layer, wherein, when a switch of the plurality of switches is in the conducting position, the switch electrically connects two conductors of the plurality of conductors to each other through their respective vias, wherein a plurality of different switch configurations of the plurality of switches provide a 2-bit phase quantization on the reflected electromagnetic wave relative to the electromagnetic wave incident on the conducting pattern layer when the electromagnetic wave is incident on the conducting pattern layer, wherein a switch configuration of each phase shift element of the plurality of phase shift elements is selected such that the plurality of phase shift elements generates a main beam of the reflected electromagnetic wave in a preselected direction when the electromagnetic wave is incident on the conducting pattern layer.

* * * * *